US005500668A

United States Patent [19]

Malhotra et al.

[11] Patent Number: 5,500,668

[45] Date of Patent: Mar. 19, 1996

[54] RECORDING SHEETS FOR PRINTING PROCESSES USING MICROWAVE DRYING

[75] Inventors: Shadi L. Malhotra, Mississauga, Canada; Kurt B. Gundlach, Pittsford; Richard L. Colt, Rochester, both of N.Y.

[73] Assignee: Xerox Corporation, Stamford, Conn.

[21] Appl. No.: 196,669

[22] Filed: Feb. 15, 1994

[51] Int. Cl.[6] ..... B41J 2/05

[52] U.S. Cl. ..... 347/105; 347/102; 347/100

[58] Field of Search ..... 347/105, 102, 347/100

[56] References Cited

U.S. PATENT DOCUMENTS

| | | | |
|---|---|---|---|
| 3,687,887 | 8/1972 | Zabiak | 347/105 |
| 4,327,174 | 4/1982 | von Meer | 430/530 |
| 4,446,174 | 5/1984 | Maekawa et al. | 427/261 |
| 4,554,181 | 11/1985 | Cousin et al. | 427/261 |
| 4,569,900 | 2/1986 | Takagi | 430/232 |
| 4,576,867 | 3/1986 | Miyamoto | 428/342 |
| 4,740,420 | 4/1988 | Akutsu et al. | 428/341 |
| 4,781,985 | 11/1988 | Desjariais | 428/421 |
| 4,786,288 | 11/1988 | Handa et al. | 8/495 |
| 4,830,911 | 5/1989 | Kojima et al. | 428/342 |
| 4,877,680 | 10/1989 | Sakaki et al. | 428/332 |
| 4,946,741 | 8/1990 | Aono et al. | 428/336 |
| 5,073,448 | 12/1991 | Vieira et al. | 428/331 |
| 5,212,008 | 5/1993 | Malhotra et al. | 428/216 |
| 5,220,346 | 6/1993 | Carreira et al. | 346/1.1 |
| 5,223,338 | 6/1993 | Malhotra | 428/342 |
| 5,372,911 | 12/1994 | Obi et al. | 430/264 |

FOREIGN PATENT DOCUMENTS

| | | |
|---|---|---|
| 0439363 | 7/1991 | European Pat. Off. . |
| 61-74880 | 4/1986 | Japan . |
| 924610 | 6/1992 | South Africa . |

*Primary Examiner*—Benjamin R. Fuller
*Assistant Examiner*—Valerie Ann Lund
*Attorney, Agent, or Firm*—Judith L. Byorick

[57] ABSTRACT

Disclosed is a printing process which comprises (a) providing a recording sheet which comprises a substrate, at least one monomeric salt, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

20 Claims, No Drawings

RECORDING SHEETS FOR PRINTING PROCESSES USING MICROWAVE DRYING

BACKGROUND OF THE INVENTION

The present invention is directed to recording sheets, such as transparency materials, filled plastics, papers, and the like. More specifically, the present invention is directed to recording sheets particularly suitable for use in ink jet printing processes. One embodiment of the present invention is directed to a printing process which comprises (a) providing a recording sheet which comprises a substrate, at least one monomeric salt, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

Recording sheets suitable for use in ink jet printing are known. For example, U.S. Pat. No. 4,740,420 (Akutsu et al.) discloses a recording medium for ink jet printing comprising a support material containing at least in the surface portion thereof a water soluble metal salt with the ion valence of the metal thereof being 2 to 4 and a cationic organic material. The cationic organic materials include salts of alkylamines, quaternary ammonium salts, polyamines, and basic latexes.

U.S. Pat. No. 4,576,867 (Miyamoto) discloses an ink jet recording paper with improved water resistance and sunlight fastness of the image formed on the paper wherein the recording paper has attached to its surface a cationic resin of the formula

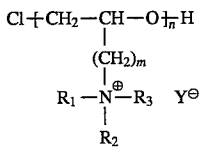

wherein $R_1$, $R_2$, and $R_3$ represent alkyl groups, m represents a number of 1 to 7, and n represents a number of 2 to 20, and Y represents an acid residue.

U.S. Pat. No. 4,446,174 (Maekawa et al.) discloses an ink jet recording method for producing a recorded image on an image receiving sheet with a jet of aqueous ink, wherein an ink jet is projected onto an image receiving sheet comprising a surface layer containing a pigment, and wherein the surface layer is capable of adsorbing a coloring component in the aqueous ink. Poly (vinyl benzyl trimethyl ammonium chloride), poly (diallyl dimethyl ammonium chloride), and poly (methacryloxyethyl-β-hydroxyethyl dimethyl ammonium chloride) are disclosed as dye absorbing adhesive materials.

U.S. Pat. No. 4,830,911 (Kojima et al.) discloses a recording sheet for ink jet printers which gives an image by the use of an aqueous ink containing a water-soluble dye, coated or impregnated with either of or a mixture of two kinds of water soluble polymers, one whose polymeric unit is alkylquaternaryammonium (meth)acrylate and the other whose polymer unit is alkylquaternaryammonium (meth)acrylamide, wherein the water soluble polymers contain not less than 50 mol percent of a monomer represented by the formula

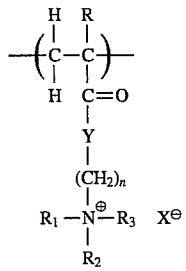

where R represents hydrogen or methyl group, n is an interger from 1 to 3 inclusive, $R_1$, $R_2$, and $R_3$ represent hydrogen or the same or different aliphatic alkyl group with 1 to 4 carbon atoms, X represents an anion such as a halogen ion, sulfate ion, alkyl sulfate ion, alkyl sulfonate ion, aryl sulfonate ion, and acetate ion, and Y represents oxygen or imino group.

U.S. Pat. No. 4,554,181 (Cousin et al.) discloses an ink jet recording sheet having a recording surface which includes a combination of a water soluble polyvalent metal salt and a cationic polymer, the polymer having cationic groups which are available in the recording surface for insolubilizing an anionic dye.

U.S. Pat. No. 4,877,680 (Sakaki et al.) discloses a recording medium comprising a substrate and a nonporous ink receiving layer. The ink receiving layer contains a water-insoluble polymer containing a cationic resin. The recording medium may be employed for recording by attaching droplets of a recording liquid thereon.

European Patent Publication 0 439 363 A1, published Jul. 31, 1991, corresponding to U.S. Pat. No. 5,302,249, the disclosure of which is totally incorporated herein by reference, discloses a paper which comprises a supporting substrate with a coating comprising (a) a desizing component selected from the group consisting of (1) hydrophilic poly(dialkylsiloxanes); (2) poly(alkylene glycol); (3) poly(propylene oxide)-poly(ethylene oxide) copolymers; (4) fatty ester modified compounds of phosphate, sorbitan, glycerol, poly(ethylene glycol), sulfosuccinic acid, sulfonic acid and alkyl amine; (5) poly(oxyalkylene) modified compounds of sorbitan esters, fatty amines, alkanol amides, castor oil, fatty acids and fatty alcohols; (6) quaternary alkosulfate compounds; (7) fatty imidazolines; and mixtures thereof, and (b) a hydrophilic binder polymer. The binder polymer may be a quaternary ammonium copolymer such as Mirapol WT, Mirapol AD-1, Mirapol AZ-1, Mirapol A-15, Mirapol-9, Merquat-100, or Merquat-550, available from Miranol Incorporated.

U.S. Pat. No. 5,223,338 (Malhotra), the disclosure of which is totally incorporated herein by reference, discloses a recording sheet which comprises a substrate and a coating consisting essentially of (1) quaternary ammonium polymers selected from the group consisting of (a) polymers of Formula I

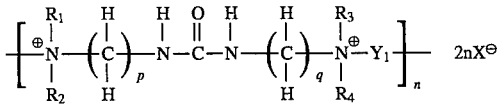

I wherein n is an integer of from 1 to about 200, $R_1$, $R_2$, $R_3$, and $R_4$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ is selected from the group consisting of $—CH_2CH_2OCH_2CH_2—$, —$CH_2CH_2OCH_2CH_2OCH_2CH_2$—, —$(CH_2)_k$—, wherein k is an integer of from about 2 to about 10, and —$CH_2CH(OH)CH_2$—; (b) polymers of Formula II

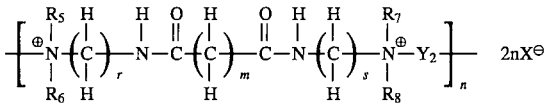

II wherein wherein n is an integer of from 1 to about 200, $R_5$, $R_6$, $R_7$, and $R_8$ are each independently selected from the group consisting of alkyl groups, hydroxyalkyl groups, and polyoxyalkylene groups, m is an integer of from 0 to about 40, r is an integer of from 1 to about 10, s is an integer of from 1 to about 10, X is an anion, and $Y_2$ is selected from the group consisting of —$CH_2CH_2OCH_2CH_2$—, —$CH_2CH_2OCH_2CH_2OCH_2CH_2$—, —$(CH_2)_k$—, wherein k is an integer of from about 2 to about 10, and —$CH_2CH(OH)CH_2$—; (c) copolymers of Formula III

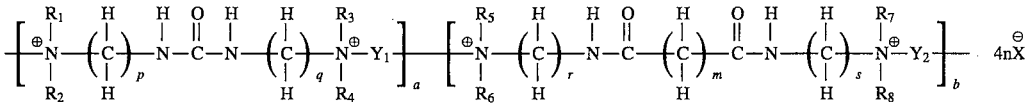

III wherein a and b are each integers wherein the sum of a +b is from about 2 to about 200, $R_1$, $R_2$, $R_3$, $R_4$, $R_5$, $R_6$, $R_7$, and $R_8$ are each independently selected from the group consisting of alkyl groups, hydroxyalkyl groups, and polyoxyalkylene groups, p is an integer of from 1 to about 10, q is an integer of from 1 to about 10, X is an anion, and $Y_1$ and $Y_2$ are each independently selected from the group consisting of —$CH_2CH_2OCH_2CH_2$—, —$CH_2CH_2OCH_2CH_2OCH_2CH_2$—, —$(CH_2)_k$—, wherein k is an integer of from about 2 to about 10, and —$CH_2CH(OH)CH_2$—; (d) mixtures of polymers of Formula I and polymers of Formula II; (e) mixtures of polymers of Formula I and copolymers of Formula III; (f) mixtures of polymers of Formula II and copolymers of Formula III; and (g) mixture of polymers of Formula I, polymers of Formula II, and copolymers of Formula III; (2) an optional binder polymer; and (3) an optional filler.

U.S. Pat. No. 5,212,008 (Malhotra et al.), the disclosure of which is totally incorporated herein by reference, discloses a recording sheet which comprises a substrate; a first coating in contact with the substrate which comprises a crosslinking agent selected from the group consisting of hexamethoxymethyl melamine, methylated melamine-formaldehyde, methylated urea-formaldehyde, cationic urea-formaldehyde, cationic polyamine-epichlorohydrin, glyoxal-urea resin, poly (aziridine), poly (acrylamide), poly (N,N-dimethyl acrylamide), acrylamide-acrylic acid copolymer, poly (2-acrylamido-2-methyl propane sulfonic acid), poly (N,N-dimethyl-3,5-dimethylene piperidinium chloride), poly (methyleneguanidine) hydrochloride, poly (ethylene imine) poly (ethylene imine) epichlorohydrin, poly (ethylene imine) ethoxylated, glutaraldehyde, and mixtures thereof; a catalyst; and a polymeric material capable of being crosslinked by the crosslinking agent and selected from the group consisting of polysaccharides having at least one hydroxy group, polysaccharides having at least one carboxy group, polysaccharides having at least one sulfate group, polysaccharides having at least one amine or amino group, polysaccharide gums, poly (alkylene oxides), vinyl polymers, and mixtures thereof; and a second coating in contact with the first coating which comprises a binder and a material selected from the group consisting of fatty imidazolines, ethosulfate quaternary compounds, dialkyl dimethyl methosulfate quaternary compounds, alkoxylated di-fatty quaternary compounds, amine oxides, amine ethoxylates, Imidazoline quaternary compounds, alkyl benzyl dimethyl quaternary compounds, poly (epiamines), and mixtures thereof.

U.S. Pat. No. 4,946,741 (Aono et al.) discloses an ink recording sheet comprising a transparent support having thereon an ink recording layer comprising a mixture of an amino group deactivated gelatin derivative and a polyalkylene oxide.

U.S. Pat. No. 4,781,985 (Desjarlais) discloses an ink jet transparency which comprises a substantially transparent resinous support and a substantially clear coating thereon which includes a specific fluorosurfactant.

U.S. Pat. No. 5,073,448 (Vieira et al.) discloses a recording material for ink jet printing comprising a carrier having a surface which can be printed on or a carrier coated on one side with a material which can be printed on, wherein the carrier or the coating contains as a stabilizer at least one compound of the formula

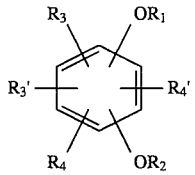

in which $R_1$ and $R_2$ independently of one another are $C_1$–$C_4$ alkyl which is unsubstituted or substituted by one or two —OH, —COO—M+ and/or —$SO_3^-$M+ groups, $C_3$–$C_5$ alkenyl, $C_3$–$C_5$ alkynyl,

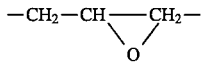

—$CH_2CH(OH)CH_2$—$SO_3$—M+, —CO-alkyl($C_1$–$C_4$) which is unsubstituted or substituted by —$COOR^o$ or —CO—N($R_5$)($R_6$) or, if $OR_1$ and $OR_2$ are in the ortho position relative to one another, $R_1$ and $R_2$ together are $C_1$–$C_6$ alkylene, M+ being H+, a monovalent, divalent or trivalent metal cation or a group ($R_{12}$')N+($R_{12}$")($R_{13}$')($R_{14}$'), wherein $R_{12}$', $R_{12}$", $R_{13}$ and $R_{14}$ independently of one another are H, $C_1$–$C_4$ alkyl which is unsubstituted or substituted by 1 or 3 OH, $C_1$–$C_4$ alkyl interrupted by O, allyl, cyclopentyl, cyclohexyl, phenyl, benzyl or tolyl, or $R_1$ is a group

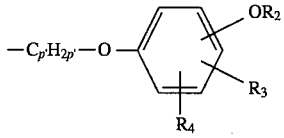

in which p' is a number from 2 to 6, $R_5$ and $R_6$ independently of one another are H or $C_1$–$C_4$ alkyl which is unsubstituted or substituted by an OH, $COOR^o$, —COO—M+, $SO_3$—M+, P(O)(O—M+)$_2$ or P(O)($OR^o$)$_2$ group, $R_3$' and $R_4$' independently of one another are H, $C_1$–$C_4$ alkyl, OH or $C_1$–$C_4$ alkoxy, $R_3$ and $R_4$ independently of one another are H, halogen, —$OR_7$, —$COOR^o$, —COO–M+, —OOC—$R_5$, —CO—$N(R_5)(R_6)$, —$(R_5)N$—CO—$R_6$, —CO—$R_5$, —$SO_3$—M+, —$SO_2N(R_5)(R_6)$, $P(OR_5)_3$, —(O)P—(O—M+)$_2$, —(O)P—$(OR^o)_2$, $C_1$–$C_8$ alkyl which is unsubstituted or substituted by 1 to 7 —$OR_5$ or —OO—C—$R_5$ groups, by 1 or 2 —$COOR^o$, —COO—M+, or —CO—$N(R_5)(R_6)$ groups or by one or two —$SO_3$–M+, —$SO_2N(R_5)(R_6)$ or —(O)P—$(OR^o)_2$ or —(O)P(O—M+)$_2$ groups, where M+, $R_5$ and $R_6$ are as defined above, or $C_5$–$C_6$ cycloalkyl or allyl, $R^o$ being $C_1$–$C_4$ alkyl which is unsubstituted or substituted by an —OH group or —$(CH_2CH_2O)_r$—H in which r is 1 to 12, and $R_7$ being $C_1$–$C_4$ alkyl or —CO-alkyl($C_1$–$C_4$) each of which is unsubstituted or substituted by 1 or 2 —OH groups or $R_3$ and $R_4$ independently of one another are one of the groups

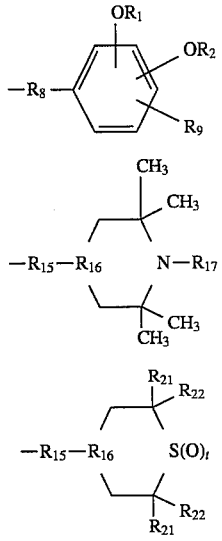

in which $R_8$ is a direct bond or methylene, $R_9$ is H, $C_1$–$C_8$ alkyl, —COO—M+ or —$SO_3$—M+, where M+, $R_1$ and $R_2$ are as defined above, $R_{15}$ is —CO—, —$(O)_g$—$C_pH_{2p}$—CO—, —OOC—$C_pH_{2p}$—, —COO—$C_pH_{2p}$—, —O—$CH_2CH(OH)$—$CH_2$— or

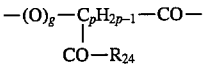

in which g is 0 or 1 and p is 1 to 6 and $R_{24}$ is —$OR_5$, —$N(R_5)(R_6)$ or a group

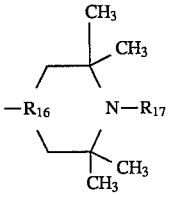

and $R_{16}$ is one of the following radicals:

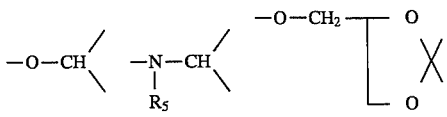

-continued

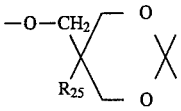

in which $R_{25}$ is H or $C_1$–$C_4$ alkyl, $R_{17}$ is H, $C_1$–$C_4$ alkyl which is unsubstituted or substituted by an —OH group, —$CH_2$—CH(OH)—$CH_2$—OH, $C_1$–$C_4$ alkoxy, —OH, —CO-alkyl($C_1$–$C_4$), —COCH=$CH_2$, allyl, benzyl or a group

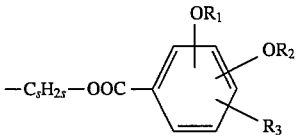

in which s is the number 2 or 3, t is a number from 0 to 2 and $R_{21}$ and $R_{22}$ independently of one another are H, $C_1$–$C_4$ alkyl or phenyl.

South African Patent Application 924,610 discloses a transparent recording sheet suitable for making visual transparencies which comprises a thin transparent film backing bearing on at least one major surface thereof an ink jet receptive layer comprising from 1% to 10% of at least one acid having a pKa of from 2 to 6, said acid being selected from the group consisting of aryl monocarboxylic acids, aryloxy monocarboxylic acids, alkyl carboxylic acids having alkyl groups containing at least 11 carbon atoms, dicarboxylic acids, tricarboxylic acids, and pyridinium salts, and at least one liquid-absorbent polymer comprising from 90% to 99% aprotic constituents, wherein said sheet shows reduced fading when imaged with an ink containing triarylmethane dye and at least one nucleophile over an identical composition containing no protic organic-solvent-soluble additive.

U.S. Pat. No. 5,220,346 (Carreira et al.), the disclosure of which is totally incorporated herein by reference, discloses a printing process which comprises applying in imagewise fashion to a substrate an ink composition which comprises an aqueous liquid vehicle, a colorant, and an ionic compound at least partially ionizable in the liquid vehicle, said ink composition having a conductivity of at least about 10 milliSiemens per centimeter, and subsequently exposing the substrate to microwave radiation, thereby drying the images on the substrate. A specific embodiment of the invention is directed to a thermal ink jet printing process which comprises (1) incorporating into a thermal ink jet printing apparatus an ink composition which comprises an aqueous liquid vehicle, a colorant, and an ionic compound at least partially ionizable in the liquid vehicle, said ink composition having a conductivity of at least about 10 milliSiemens per centimeter; (2) heating the ink in an imagewise pattern to cause bubbles to form therein, thereby causing droplets of the ink to be ejected in an imagewise pattern onto a substrate, thereby generating images on the substrate; and (3) exposing the substrate to microwave radiation, thereby drying the images on the substrate.

Japanese Patent Publication JP 61-74880-A discloses a recording paper which contains (a) dimethyl diallylammonium chloride polymer; and (b) water soluble metal salt, such as CaF, LiCl, NaCl, KCl, RbCl, CrCl, KBr, LiI, $Na_2SO_4$, $K_2HPO_3$, $K_3PO_4$, $MgCl_2$, $ZnCl_2$, $MgCdSO_4$, or the like. The paper is used in ink jet recording, especially for multicolored recording, and is improved in preventing color tone difference due to the different printing order by each color ink while maintaining good water resistance.

U.S. Pat. No. 4,786,288 (Handa et al.), the disclosure of which is totally incorporated herein by reference, discloses an ink applying method for obtaining desired sharp patterns while preventing bleeding and an ink composition therefor, in applying a low viscosity liquid to a polymer product such as fabric in the form of droplets according to the ink jet or spray process. As a treating solution there is used a solution incorporating a water-soluble or water-dispersible material which contains —$OSO_3M$ group or —$SO_3M$ group as a hydrophilic group in which M is a monovalent metal, ammonium or amine, and a fiber structure is pretreated with a chemical for coagulating the said hydrophilic group, whereby good bleeding preventing effect and deep shading effect even against markedly bleeding fiber structures such as thin fabrics as well as level dyeing effect of colored portions can be attained without impairing the injection characteristic. Sharp patterns equal or superior to conventional prints can be obtained.

Copending application U.S. Ser. No. 08/034,917 (Attorney Docket No. D/92586), with the named inventors Shadi L. Malhotra, Brent S. Bryant, and Doris K. Weiss, filed Mar. 19, 1993, entitled "Recording Sheets Containing Phosphonium Compounds," the disclosure of which is totally incorporated herein by reference, discloses a recording sheet which comprises a base sheet, a phosphonium compound, an optional pigment, and an optional binder. In a preferred embodiment, the phosphonium compound is selected from the group consisting of

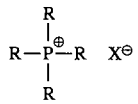

I wherein R is an alkyl group, X is an anion, and all four R groups are the same;

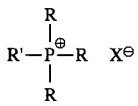

II wherein R is an alkyl group, wherein all three R groups are the same, wherein R is not the same as R', X is an anion, and R' is selected from the group consisting of alkyl groups, substituted alkyl groups, arylalkyl groups, and substituted arylalkyl groups;

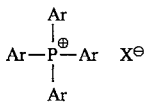

III wherein Ar is an aryl group or a substituted aryl group, X is an anion, and all four Ar groups are the same;

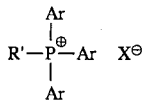

IV wherein Ar is an aryl group or a substituted aryl group, wherein all three Ar groups are the same, X is an anion, and R' is selected from the group consisting of alkyl groups, substituted alkyl groups, arylalkyl groups, and substituted arylalkyl groups; and mixtures thereof.

U.S. Pat. No. 5,314,747 (Malhotra et al.) the disclosure of which is totally incorporated herein by reference, discloses a recording sheet which comprises (a) a base sheet; (b) a cationic sulfur compound selected from the group consisting of sulfonium compounds, thiazolium compounds, benzothiazolium compounds, and mixtures thereof; (c) an optional binder; and (d) an optional pigment.

Copending application U.S. Ser. No. 08/033,917 (Attorney Docket No. D/92587), with the named inventors Shadi L. Malhotra and Brent S. Bryant, filed Mar. 19, 1993, entitled "Recording Sheets Containing Pyridinium Compounds," the disclosure of which is totally incorporated herein by reference, discloses a recording sheet which comprises a base sheet and a material selected from the group consisting of pyridinium compounds, piperazinium compounds, and mixtures thereof.

U.S. Pat. No. 5,320,902 (Malhotra et al.) the disclosure of which is totally incorporated herein by reference, discloses a recording sheet which consists essentially of a substrate and, in contact with the substrate, a monoammonium compound of the formula:

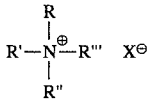

I wherein R is an alkyl group, X is selected from the group consisting of fluoride, chloride, bromide, iodide, and astatide, and R', R", and R"' are each independently selected from the group consisting of alkyl groups, substituted alkyl groups, aryl groups, substituted aryl groups, arylalkyl groups, and substituted arylalkyl groups, wherein R, R', R" and R"' are either the same as or different from each other; and mixtures thereof; an optional binder component; and an optional filler component.

Copending application U.S. Ser. No. 08/033,918 (Attorney Docket No. D/92591), with the named inventors Shadi L. Malhotra, Brent S. Bryant, and Doris K. Weiss, filed Mar. 19, 1993, entitled "Recording Sheets Containing Tetrazolium, Indolinium, and Imidazolinium Compounds," the disclosure of which is totally incorporated herein by reference, discloses a recording sheet which comprises (a) a base sheet; (b) a material selected from the group consisting of tetrazolium compounds, indolinium compounds, imidazolinium compounds, and mixtures thereof; (c) an optional pigment; and (d) an optional binder.

Copending application U.S. Ser. No. 08/196,922, with the named inventor Shadi L. Malhotra, filed concurrently herewith, entitled "Recording Sheets Containing Alcohols and Saccharides," the disclosure of which is totally incorporated herein by reference, discloses a recording sheet which comprises a substrate and a material selected from the group consisting of monosaccharides, oligosaccharides, and mixtures thereof. Another embodiment of the present invention is directed to a printing process which comprises (a) providing a recording sheet which comprises a substrate, a material selected from the group consisting of monomeric alcohols, monosaccharides, oligosaccharides, and mixtures thereof, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

Copending application U.S. Ser. No. 08/196,679, with the named inventor Shadi L. Malhotra, filed concurrently herewith, entitled "Recording Sheets Containing Amino Acids, Hydroxy Acids, and Polycarboxyl Compounds," the disclosure of which is totally incorporated herein by reference, discloses a recording sheet which comprises a paper substrate and a material selected from the group consisting of monomeric amino acids, monomeric hydroxy acids, monomeric polycarboxyl compounds, and mixtures thereof. Another embodiment of the present invention is directed to a recording sheet which comprises a substrate and an additive material selected from the group consisting of monomeric amino acids, monomeric hydroxy acids, and mixtures thereof.

Copending application U.S. Ser. No. 08/196,607, with the named inventor Shadi L. Malhotra, filed concurrently herewith, entitled "Recording Sheets Containing Amine Salts and Quaternary Choline Halides," the disclosure of which is totally incorporated herein by reference, discloses a recording sheet which comprises a substrate and a material selected from the group consisting of monomeric amine acid salts, monomeric quaternary choline halides, and mixtures thereof.

Copending application U.S. Ser. No. 08,196,676, with the named inventor Shadi L. Malhotra, filed concurrently herewith, entitled "Recording Sheets Containing Pyrrole, Pyrrolidine, Pyridine, Piperidine, Homopiperidine, Quinoline, Isoquinoline, Quinuclidine, Indole, and Indazole Compounds," the disclosure of which is totally incorporated herein by reference, discloses a recording sheet which comprises a substrate and an additive material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof.

Copending application U.S. Ser. No. 08/196,933, with the named inventor Shadi L. Malhotra, filed concurrently herewith, entitled "Recording Sheets Containing Purine, Pyrimidine, Benzimidazole, Imidazolidine, Urazole, Pyrazole, Triazole, Benzotriazole, Tetrazole, and Pyrazine Compounds," the disclosure of which is totally incorporated herein by reference, discloses a recording sheet which comprises a substrate and a material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof. Also disclosed is a recording sheet which consists essentially of a substrate, at least one material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof, an optional binder, an optional antistatic agent, an optional biocide, and an optional filler.

Copending application U.S. Ser. No. 08/196,672, with the named inventor Shadi L. Malhotra, filed concurrently herewith, entitled "Recording Sheets Containing Oxazole, Isooxazole, Oxazolidinone, Oxazoline Salt, Morpholine, Thiazole, Thiazolidine, Thiadiazole, and Phenothiazine Compounds," the disclosure of which is totally incorporated herein by reference, discloses a recording sheet which comprises a substrate and a material selected from the group consisting of oxazole compounds, isooxazole compounds, oxazolidinone compounds, oxazoline salt compounds, morpholine compounds, thiazole compounds, thiazolidine compounds, thiadiazole compounds, phenothiazine compounds, and mixtures thereof. Also disclosed is a recording sheet which consists essentially of a substrate, at least one material selected from the group consisting of oxazole compounds, isooxazole compounds, oxazolidinone compounds, oxazoline salt compounds, morpholine compounds, thiazole compounds, thiazolidine compounds, thiadiazole compounds, phenothiazine compounds, and mixtures thereof, an optional binder, an optional antistatic agent, an optional biocide, and an optional filler.

Copending application U.S. Ser. No. 08/196,605, with the named inventors Shadi L. Malhotra, Brent S. Bryant, and Arthur Y. Jones, filed concurrently herewith, entitled "Recording Sheets Containing Mildew Preventing Agents," the disclosure of which is totally incorporated herein by reference, discloses a recording sheet which comprises a substrate, an image receiving coating, and a biocide.

While known compositions and processes are suitable for their intended purposes, a need remains for improved recording sheets. In addition, there is a need for improved recording sheets suitable for use in ink jet printing processes. Further, a need remains for recording sheets which exhibit rapid drying times when imaged with aqueous inks. Additionally, there is a need for recording sheets which enable precipitation of a dye from a liquid ink onto the sheet surface during printing processes. A need also remains for recording sheets which are particularly suitable for use in printing processes wherein the recorded substrates are imaged with liquid inks and dried by exposure to microwave radiation. Further, there is a need for recording sheets coated with a discontinuous, porous film. There is also a need for recording sheets which, subsequent to being imaged with an aqueous ink and dried by exposure to microwave radiation, exhibit little or no curling. In addition, there is a need for recording sheets suitable for use in thermal ink jet printing followed by exposure to microwave drying, wherein the imaged sheets exhibit increased solid area density. Further, a need exists for recording sheets suitable for use in thermal ink jet printing followed by exposure to microwave drying, wherein the imaged sheets exhibit improved resistance to showthrough. Additionally, there is a need for recording sheets suitable for use in thermal ink jet printing followed by exposure to microwave drying, wherein the imaged sheets exhibit reduced feathering. There is also a need for recording sheets suitable for use in thermal ink jet printing followed by exposure to microwave drying, wherein the imaged sheets exhibit intercolor bleed.

SUMMARY OF THE INVENTION

It is an object of the present invention to provide recording sheets with the above noted advantages.

It is another object of the present invention to provide recording sheets suitable for use in ink jet printing processes.

It is yet another object of the present invention to provide recording sheets which exhibit rapid drying times when imaged with aqueous inks.

It is still another object of the present invention to provide recording sheets which enable precipitation of a dye from a liquid ink onto the sheet surface during printing processes.

Another object of the present invention is to provide recording sheets which are particularly suitable for use in printing processes wherein the recorded substrates are imaged with liquid inks and dried by exposure to microwave radiation.

Yet another object of the present invention is to provide recording sheets coated with a discontinuous, porous film.

Still another object of the present invention is to provide recording sheets which, subsequent to being imaged with an aqueous ink and dried by exposure to microwave radiation, exhibit little or no curling.

It is another object of the present invention to provide recording sheets suitable for use in thermal ink jet printing followed by exposure to microwave drying, wherein the imaged sheets exhibit increased solid area density.

It is yet another object of the present invention to provide recording sheets suitable for use in thermal ink jet printing followed by exposure to microwave drying, wherein the imaged sheets exhibit improved resistance to showthrough.

It is still another object of the present invention to provide recording sheets suitable for use in thermal ink jet printing followed by exposure to microwave drying, wherein the imaged sheets exhibit reduced feathering.

Another object of the present invention is to provide recording sheets suitable for use in thermal ink jet printing followed by exposure to microwave drying, wherein the imaged sheets exhibit intercolor bleed.

These and other objects of the present invention (or specific embodiments thereof) can be achieved by providing a printing process which comprises (a) providing a recording sheet which comprises a substrate, at least one monomeric salt, an optional binder, an optional antistatic agent, an optional biocide, and an optional filler; (b) applying an aqueous recording liquid to the recording sheet in an image-wise pattern; and (c) thereafter exposing the substrate to microwave radiation, thereby drying the recording liquid on the recording sheet

DETAILED DESCRIPTION OF THE INVENTION

The recording sheets used in the process of the present invention comprise a substrate and a monomeric salt. Any suitable substrate can be employed. Examples include transparent materials, such as polyester, including Mylar™, available from E. I. Du Pont de Nemours & Company, Melinex™, available from Imperial Chemicals, Inc., Celanar™, available from Celanese Corporation, polyethylene naphthalates, such as Kaladex PEN Films, available from Imperial Chemical Industries, polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI America Incorporated, those prepared from biphenylene, such as Astrel™, available from 3M Company, poly (arylene sulfones), such as those prepared from crosslinked poly(arylene ether ketone sulfones), cellulose triacetate, polyvinylchloride cellophane, polyvinyl fluoride, polyimides, and the like, with polyester such as Mylar™ being preferred in view of its availability and relatively low cost. The substrate can also be opaque, including opaque plastics, such as Teslin™, available from PPG Industries, and filled polymers, such as Melinex®, available from ICI. Filled plastics can also be employed as the substrate, particularly when it is desired to make a "never-tear paper" recording sheet. Paper is also suitable, including plain papers such as Xerox® 4024, diazo papers, or the like.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company-Anatase grade AHR), calcium silicate CH-427-97-8, XP-974 (J. M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox® 4024™ papers and sized calcium silicate-clay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

Situated on the substrate is a monomeric salt. The monomeric salt may be either an organic salt or an inorganic salt, and may be a hydrated salt or a nonhydrated salt.

Suitable inorganic salts include salts of cations such as ammonium, lithium, sodium, potassium, rubidium, cesium, beryllium, magnesium, calcium, barium, strontium, aluminum, scandium, titanium, vanadium, chromium, manganese, iron, cobalt, nickel, copper, zinc, gallium, germanium, yttrium, zirconium, niobium, molybdenum, rubidium, rhodium, palladium, silver, cadmium, indium, tin, antimony, lanthanum, halfnium, tantalum, tungsten, rhenium, osmium, iridium, platinum, gold, mercury, thallium, lead, bismuth, terbium, selenium, tellurium, ruthenium, neodymium, thulium, and the like, as well as mixtures thereof, and of anions such as fluoride, chloride, bromide, iodide, astatide, oxide, sulfide, phosphate, hydrogen phosphate, dihydrogen phosphate, pyrophosphate ($P_2O_7^{2-}$), polyphosphate, sulfate, hydrogen sulfate (bisulfate), pyrosulfate ($S_2O_7^{2-}$), sulfite, hydrogen sulfite (bisulfite), pyrosulfite ($S_2O_5^{2-}$), thiosulfate, carbonate, hydrogen carbonate (bicarbonate), tetraborate ($B_4O_7^{-}$), metaborate (perborate; $BO_3^{-}$), tetrafluoroborate ($BF_4^{-}$), metasilicate ($SiO_3^{-}$), trisilicate ($Si_3O_7^{2-}$), hexafluorosilicate ($SiF_6^{2-}$), hexafluorophosphate ($PF_6^{-}$), hexafluorotitanate ($TiF_6^{2-}$), hexafluorozirconate ($ZrF_6^{2-}$), hexafluoroaluminate ($AlF_6^{3-}$), nitrate, nitrite, hydroxide, and the like, as well as mixtures thereof.

Specific examples of suitable inorganic salts include ammonium phosphate dibasic $(NH_4)_2HPO_4$ (Aldrich 33,879-6); ammonium sulfate $(NH_4)_2SO_4$ (Aldrich 22,125-2); ammonium sulfite $(NH_4)_2SO_3$ (Aldrich 35,898-3); ammonium thiosulfate $(NH_4)_2S_2O_3$ (Aldrich 33,672-6); ammonium bromide $NH_4Br$ (Aldrich 21,334-9); ammonium carbonate $(NH_4)_2CO_3$ (Aldrich 20,786-1); ammonium hydrogen sulfate $NH_4HSO_4$ (Aldrich 30,760-2); ammonium bicarbonate $NH_4HCO_3$ (Aldrich 28,509-9); ammonium chloride $NH_4Cl$ (Aldrich 21,333-0); ammonium dihydrogen phosphate $(NH_4)$ $H_2PO_4$ (Aldrich 33,885-0); ammonium tetraborate tetrahydrate $(NH_4)_2B_4O_7.4H_2O$ (Aldrich 30,909-5); ammonium iron sulfate hexahydrate $((NH_4)_2Fe(SO_4)_2.6H_2O$ (Aldrich 21,540-6); ammonium iron sulfate dodecahydrate $(NH_4)Fe(SO_4)_2.12H_2O$ ,(Aldrich 22,126-0); potassium bromide KBr (Aldrich 24,341-8); potassium carbonate $K_2CO_3$ (Aldrich 20,961-9); potassium carbonate sesquihydrate $K_2CO_3.1½H_2O$ (Aldrich 24,355-8); potassium chloride KCl (Aldrich 20,800-0); potassium hexafluorophosphate $KPF_6$ (Aldrich 20,091-3); potassium hexafluorosilicate $K_2SiF_6$ (Aldrich 30,666-1); potassium hexafluorotitanate $K_2T_1F_6$ (Aldrich 30,838-2); potassium hexafluorozirconate $K_2ZrF_6$ (Aldrich 33,668-8); potassium hydrogen carbonate $KHCO_3$ (Aldrich 23,720-5); potassium hydrogen sulfate $KHSO_4$ (Aldrich 22,347-6); potassium iodide KI (Aldrich 22,194-5); potassium pyrophosphate $K_4P_2O_7$ (Aldrich 32,243-1); potassium pyrosulfate $K_2S_2O_7$ (Aldrich 30,775-0); potassium sulfate $K_2SO_4$ (Aldrich 22,349-2); potassium sulfite $K_2SO_3$ (Aldrich 28,981-7); potassium tetrafluoroborate $KBF_4$ (Aldrich 27,895-5); potassium phosphate monobasic $KH_2PO_4$ (Aldrich 34,241-6); potassium phosphate tribasic $K_3PO_4$ (Aldrich 34,076-6); potassium tetraborate tetrahydrate (Aldrich 28,979-5); sodium bisulfate $NaHSO_4$ (Aldrich 30,782-3); sodium bisulfate monohydrate $NaHSO_4.H_2O$ (Aldrich 23,371-4); sodium ammonium hydrogen phosphate tetrahydrate $NaNH_4(HPO_4).4H_2O$ (Aldrich 24,350-7); sodium bisulfite $NaHSO_3$ (Aldrich 24,397-3); sodium bromide NaBr (Aldrich 22,034-5); sodium carbonate $Na_2CO_3$ (Aldrich 22,232-1); sodium chloride NaCl (Aldrich 31,016-6); sodium hexafluoro aluminate $Na_3AlF_6$ (Aldrich 30,549-9); sodium hexafluoro silicate $Na_2SiF_6$(Aldrich 25,017-1); sodium hydrogen carbonate $NaHCO_3$ (Aldrich 34,094-4); sodium iodide NaL (Aldrich 21,763-8); sodium iodide dihydrate (Aldrich 21,730-1); sodium pyrosulfite $Na_2S_2O_5$ (Aldrich 25,555-6); sodium metaborate hydrate $NaBO_2.xH_2O$ (Aldrich 22,870-2); sodium metasilicate $Na_2SiO_3$ (Aldrich 30,781-5); sodium nitrite $NaNO_2$ (Aldrich 34,766-3); sodium perborate tetrahydrate $NaBO_3.4H_2O$ (Aldrich 24,412-0); sodium phosphate monobasic $NaH_2PO_4$ (Aldrich 33,198-8); sodium phosphate monobasic mono hydrate $NaH_2PO_4.H_2O$ (Aldrich 22,352-0); sodium sulfate $Na_2SO_4$ (Aldrich 23,931-3); sodium sulfite $Na_2SO_3$ (Aldrich 20,784-5); sodium tripolyphosphate $Na_5P_3O_{10}$ (Aldrich 23,850-3); sodium trisilicate $Na_2Si_3O_7$ (Aldrich 35,864-9); soda ash (a blend of $Na_2CO_3$ and $Na_2O$) (Aldrich 33,036-1); sodium thiosulfate pentahydrate (Aldrich 21,724-7); sodium pyrophosphate decahydrate (Aldrich 22,136-8); magnesium bromide hexahydrate $MgBr_2.6H_2O$ (Aldrich 21,684-4); magnesium chloride hexahydrate $MgCl_2.6H_2O$ (Aldrich 20,895-7); magnesium nitrate hexahydrate $Mg(NO_3)_2.6H_2O$ (Aldrich 23,717-5); magnesium sulfate heptahydrate $MgSO_4.7H_2O$ (Aldrich 23,039-1); magnesium hydrogen phosphate trihydrate $MgHPO_4.3H_2O$ (Aldrich 34,075-8); magnesium carbonate magnesium hydroxide pentahydrate $(MgCO_3)_4.(Mg(OH)_2).5H_2O$ (Aldrich 22,766-8); aluminum sulfate hexadecahydrate $Al_2(SO_4)_3.16H_2O$ (Aldrich 22,761-7); aluminum potassium sulfate dodecahydrate $AlK(SO_4).12H_2O$ (Aldrich 23,708-6); aluminum ammonium sulfate dodecahydrate $AlNH_4(SO_4)_2.12H_2O$ (Aldrich 22,170-8); barium hydroxide octahydrate $Ba(OH)_2.8H_2O$ (Aldrich 21,757-3); calcium nitrate tetrahydrate $Ca(NO_3)_2.4H_2O$ (Aldrich 23,712-4); calcium sulfate dihydrate $CaSO_4.2H_2O$ (Aldrich 25,554-8); strontium chloride hexahydrate $SrCl_2.6H_2O$ (Aldrich 25,552-1); zinc nitrate hexahydrate Zn $(NO_3)_2.6H_2O$ (Aldrich 22,873-7); zinc sulfate heptahydrate $ZnSO_4.7H_2O$ (Aldrich 22,137-6); and the like.

Suitable organic salts include those with cations such as those indicated above with respect to inorganic salts. Suitable organic anions for the salt include carboxylate anions, such as anions of aliphatic acids, with examples including formate, acetate, propionate, butyrate, octanoate, oxalate, hydrogen oxalate, fumarate, oleate, 2,4-hexanedienate, palmitate, linoleate, succinate, malonate, maleate, D,L-isocitrate, stearate, and the like, anions of substituted aliphatic acids, with examples including 4-hydroxybutyrate, 4-hydroxybenzyl formate, D,L-2-hydroxy valerate, 2,2-dichloropropionate, 3-methyl-2-oxobutanoate, 4-methyl-2-oxopentanoate, 2-ketobutyrate, 3-(trimethylsilyl) propionate, phenoxyacetate, iminodiacetate, nitrilo triacetate, acetoacetate, carbamate, L-tartarate, citrate, D-lactate, 2-ketoglutarate, D-gluconate, pyruvate, pantothenate, dihydroxytartarate, malate, epoxy succinate, 2-keto-D-gluconate, D,L-glycerate, D,L-ketomalonate, and the like, anions of aromatic acids, with examples including benzoate, phthalate, hydrogen phthalate, terephthalate, and the like, anions of substituted aromatic acids, with examples including 4-aminobenzoate, 4,4'-dihydroxy azobenzene-3,3'-dicarboxylate, hippurate, 4-aminosalicylate, phenoxyacetate, peroxyphthalate, glycyrhizate, and the like; organic sulfate anions, including aliphatic sulfates, such as methyl sulfate, octyl sulfate, dodecyl sulfate, tetradecyl sulfate, octadecyl sulfate, and the like, substituted aliphatic sulfates, such as 3,5-dimethyl cyclohexyl sulfate, and the like, aromatic sulfates, such as 2-naphthyl sulfate, and the like, substituted aromatic sulfates, such as 4-nitrophenyl sulfate, and the like; organic sulfonate anions, including aliphatic sulfonates, such as 1-butane sulfonate, 1-pentane sulfonate, 1-hexane sulfonate, 1-heptane sulfonate, 1-octane sulfonate, 1-decane sulfonate, 1-dodecane sulfonate, 1-hexadecane sulfonate, vinyl sulfonate, 2-methyl-2-propene-1-sulfonate, and the like, substituted aliphatic sulfonates, such as 2-chloroethane sulfonate, 3-chloro-2-hydroxy-1-propane sulfonate, 3-amino-1-propane sulfonate, cyclohexyl sulfamic acid salts, dioctyl sulfosuccinate, and the like, aromatic sulfonates, such as benzene sulfonate, 1,3-benzene disulfonate, p-toluene sulfonate, dodecyl benzene sulfonate, 4-octylbenzene sulfonate, xylene sulfonate, and the like, and substituted aromatic sulfonates, such as 4-sulfobenzoate, 2,5-dihydroxy-1,4-benzene disulfonate, p-toluene thiosulfonate, 4-acetyl benzene sulfonate, 4-hydroxybenzene sulfonate, 3-nitrobenzene sulfonate, diphenylamine-4-sulfonate, 2,4-dinitrobenzene sulfonate, 2-formyl benzene sulfonate, 3,5-dichloro-2-hydroxybenzene sulfonate, 4-chloro-3-nitrobenzene sulfonate, pentafluorobenzene sulfonate, sulfanilic acid salts, 3,5-dibromo sulfanilic acid salts, 4-amino-1-naphthalene sulfonate, 6,7-dihydroxy-2-naphthalene sulfonate, 3,6-dihydroxy naphthalene-2,7-disulfonate, 4,5-dihydroxy naphthalene-2,7-disulfonate, 8-hydroxy-7-(4-sulfo-1-naphthylazo)-5-quinoline sulfonate, 2,6-naphthalene disulfonate, 1,3,6-naphthalene trisulfonate, 3-amino-2,7-naphthalene disulfonate, and the like; organic molecules with $SO_2$-groups, such as benzene sulfinic acid salts, N-acetyl sulfanilamide salts, chloramine-B-hydrate, chloramine-T hydrate, and the like; organic phosphate anions, such as glycerol 2-phosphate, guanosine 2'(3')monophosphate, 4-nitrophenyl phosphate, 2'-deoxy guanosine 5'monophosphate, α-D-glucose-1 -phosphate, cytidine 5'-monophosphate, choline chloride phosphate, 2-naphthyl phosphate, 2-cyanoethyl phosphate, and the like; magnesium acetate tetrahydrate $(CH_3COO)_2$ Mg.4 $H_2O$ (Aldrich 22,976-8); calcium oxalate hydrate ($O_2C$ $CO_2$) Ca.x$H_2O$ (Aldrich 28,984); zinc acetate dihydrate $(CH_3COO)_2Zn.2H_2O$ (Aldrich 22,335-2); and the like; and any other suitable organic anion, as well as mixtures thereof.

Specific examples of suitable organic salts include benzoic acid ammonium salt $C_6H_5COONH_4$ (Aldrich 18,333-4); L-tartaric acid diammonium salt $[—CH(OH)COONH_4]_2$ (Aldrich 22,892-3); ammonium citrate $HOC(COOH)(CH_2COONH_4)_2$ (Aldrich 24,756-1); ammonium hydrogen oxalate hemihydrate $(NH_4)HC_2O_4.\cdot½H_2O$ (Aldrich 28,027-5); ammonium oxalate monohydrate $(NH_4)_2C_2O_4.H_2O$ (Aldrich 22,171-6); ammonium carbamate $NH_4COONH_4$ (Aldrich 29,283-4); glycyrhizic acid ammonium salt-trihydrate (Aldrich 23,224-6); acetic acid lithium salt dihydrate $CH_3COOLi.2H_2O$ (Aldrich 21,319-5); D-lactic acid lithium salt $CH_3CH(OH)COOLi$ (Aldrich 23,391-9); acetoacetic acid lithium salt $CH_3COCH_2COOLi$ (Aldrich 23,383-6); citric acid trilithium salt hydrate $LiOOC—CH_2—C(OH)(COOLi)CH_2COOLi.xH_2O$ (Aldrich 21,320-9); dodecyl sulfate lithium salt $CH_3(CH_2)_{11}OSO_3Li$ (Aldrich 86,190-1); formic acid potassium salt HCOOK (Aldrich 29,445-4); acetic acid potassium salt $CH_3COOK$ (Aldrich 23, 649-7); benzoic acid potassium salt $C_6H_5COOK$ (Aldrich 29,000-9); oleic acid potassium salt $CH_3(CH_2)_7CH=CH(CH_2)_7COOK$ (Aldrich 29,124-2); 2,4-hexadienoic acid potassium salt $CH_3CH=CH—CH=CH—COOK$ (Aldrich 35,976-9); 2-ketoglutaric acid mono potassium salt $HOOCCH_2CH_2CO$-COOK (Aldrich 27,171-3); potassium oxalate monohydrate KOOC-COOK-$H_2O$ (Aldrich 22,342-5); L-tartaric acid dipotassium salt hydrate $KOOC—CH(OH)CH(OH)COOK.xH_2O$ (Aldrich 28,994-9); D-gluconic acid potassium salt $HOCH_2[CH(OH)]_4COOK$ (Aldrich 86,037-9); potassium hydrogen phthalate 2-$(HOOC)C_6H_4COOK$ (Aldrich 17,992-2); citric acid, tripotassium salt monohydrate $KOOC—CH_2—C(OH)(COOK)—CH_2—COOK.$ $H_2O$ (Aldrich 36,017-1); 4-sulfo benzoic acid potassium salt $KO_3S—C_6H_4COOH$ (Aldrich 31,063-8); 4-nitrophenyl sulfate potassium salt $O_2N—C_6H_4OSO_3K$ (Aldrich 85,649-5); 3,5-dimethyl cyclohexyl sulfate potassium salt $(CH_3)_2C_6H_9O—SO_3K$ (Aldrich 25,031-7); 1,3-benzene disulfonic acid dipotassium salt $C_6H_4(SO_3K)_2$ (Aldrich B315-9); 2,5-dihydroxy-1,4-benzene disulfonic acid dipotassium salt $(HO)_2C_6H_4(SO_3K)_2$ (Aldrich 16,076-8); p-toluene thio sulfonic acid potassium salt $CH_3C_6H_4SO_2SK$ (Aldrich 30,432-8); acetic acid sodium salt $CH_3COONa$ (Aldrich 22,987-3); propionic acid sodium salt $CH_3(CH_2)COONa$ (Aldrich 10,919-3); butyric acid sodium salt $CH_3(CH_2)_2COONa$ (Aldrich 30,341-0); octanoic acid sodium salt $CH_3(CH_2)_6COONa$ (Aldrich 26,939-5); palmitic acid sodium salt $CH_3(CH_2)_{14}COONa$ (Aldrich 28,690-7); formic acid sodium salt HCOONa (Aldrich 10,760-3); benzoic acid sodium salt $C_6H_5COONa$ (Aldrich 10,916-9); 4-hydroxybutyric acid sodium salt $HO(CH_2)_3COONa$ (Aldrich H2,222-1); 4-hydroxybenzyl formic acid sodium salt $HOC_6H_4CO$-COONa (Aldrich 26,058-4); D,L-2-hydroxy valeric acid sodium salt hydrate $CH_3(CH_2)_2CH(OH)COONa$-x$H_2O$ (Aldrich 21,998-3); D-gluconic acid sodium salt $HOCH_2[CH(OH)]_4COONa$ (Aldrich 18,633-3); 2,2-dichloropropionic acid sodium salt $CH_3CCl_2COONa$ (Aldrich 29,115-3); 3-methyl-2-oxobutanoic acid sodium salt $(CH_3)_2CH—CO—COONa$ (Aldrich 19,899-4); 4-methyl-2-oxopentanoic acid sodium salt $(CH_3)_2CH—CH_2CO—COONa$ (Aldrich 19,898-6); 2-keto butyric acid sodium salt monohydrate $C_2H_5CO—COONa.$ $H_2O$ (Aldrich 28,636-2); (2-keto glutaric acid monosodium salt $HOOC—CH_2—CH_2—CO—COONa$ (Aldrich 27,170-5); pyruvic acid sodium salt $CH_3CO—COONa$ (Aldrich P7,622-5); 3-(trimethylsilyl) propionic acid sodium salt $(CH_3)_3Si(CH_2)_2COONa$ (Aldrich 18,033-5); linoleic acid sodium salt $CH_3(CH_2)_4CH=CHCH_2CH=CH(CH_2)_7COONa$ (Aldrich 28,643-5); pantothenic acid sodium salt $HOCH_2C(CH_3)_2CH(OH)CONH(CH_2)_2COONa$ (Aldrich 28,316-9); hippuric acid sodium salt hydrate $C_6H_5CONHCH_2COONa.xH_2O$ (Aldrich 27,164-0); 4-amino benzoic acid sodium salt $H_2NC_6H_4COONa$ (Aldrich 85,291-0); 4-amino salicyclic acid sodium salt dihydrate $H_2NC_6H_3—2(OH)COONa.2H_2O$ (Aldrich 85,654-1); phenoxy acetic acid sodium salt hemihydrate $C_6H_5OCH_2COONa.½H_2O$ (Aldrich 19,422-0); oleic acid sodium salt $CH_3(CH_2)_7CH=CH(CH_2)_7COONa$ (Aldrich 23,397-8); succinic acid disodium salt $NaOOC—CH_2CH_2COONa$ (Aldrich 22,473-1); dihydroxy tartaric acid disodium salt hydrate $NaOOC(HO)_2—C—(OH)_2—COONa.xH_2O$ (Aldrich 16,342-2); terephthalic acid disodium salt hydrate $C_6H_4$—1,4-$(COONa)_2$ (Aldrich 28,082-8); malonic acid disodium salt monohydrate $NaOOCCH_2COONa.H_2O$ (Aldrich 28,654-0); D,L-malic acid disodium salt hydrate $NaOOCCH_2CH(OH)COONa.xH_2O$ (Aldrich 30,849-8); L-tartaric acid disodium salt dihydrate $NaOOCCH(OH)CH(OH)COONa.2H_2O$ (Aldrich 22,872-9); 4,4'-dihydroxy azobenzene-3,3'-dicarboxylic acid disodium salt $[=NC_6H_3(OH)COONa]_2$ (Aldrich 32,680-1); iminodiacetic acid disodium salt monohydrate $HN(CH_2COONa)_2.H_2O$ (Aldrich 1-120-0); ketomalonic acid monohydrate disodium salt $NaOOCC(OH)_2COONa$ (Aldrich K220-8); fumaric acid disodium salt NaOOC-CH=CH-COONa (Aldrich 23,456-7); maleic acid disodium salt monohydrate NaOOC-CH=CH-COONa. $H_2O$ (Aldrich 23,457-5; citric acid disodium salt $NaOOCCH_2C(OH)(COOH)CH_2COONa$ (Aldrich 35,908-4); epoxy succinic acid disodium salt $NaOOC—CH(O)CH—COONa$ (Aldrich 25,894-6); citric acid trisodium salt dihydrate $NaOOCCH_2C(OH)(COONa)CH_2COONa.2H_2O$ (Aldrich 85,578-2); D,L-isocitric acid trisodium salt hdyrate $NaOOCCH_2CH(COONa)CH(OH)COONa$-x$H_2O$ (Aldrich 22,008-6); nitrilo triacetic acid trisodium salt monohydrate $N(CH_2COONa)_3$-$H_2O$ (Aldrich 10,630-5); 1-butane sulfonic acid sodium salt $CH_3(CH_2)_3SO_3Na$ (Aldrich 22,151-1); 1-pentane sulfonic acid sodium salt $CH_3(CH_2)_4SO_3Na$ (Aldrich 22,153-8); 1-hexane sulfonic acid sodium salt $CH_3(CH_2)SO_3Na$ (Aldrich 22,154-6); 1-heptane sulfonic acid sodium salt $CH_3(CH_2)_6SO_3Na$ (Aldrich 22,155-4); 1-octane sulfonic acid sodium salt $CH_3(CH_2)_7SO_3Na$ (Aldrich 22,156-2); 1-decane sulfonic acid sodium salt $CH_3(CH_2)_9SO_3Na$ (Aldrich 22,157-0); 1-dodecane sulfonic acid sodium salt $CH_3(CH_2)_{11}SO_3Na$ (Aldrich 10,643-7); 1-hexadecane sulfonic acid sodium salt $CH_3(CH_2)_{15}SO_3Na$ (Aldrich 10,641-0); methyl sulfate sodium salt hydrate $CH_3OSO_3Na.xH_2O$ (Aldrich 31,818-3); octyl sulfate sodium salt $CH_3(CH_2)_7OSO_3Na$ (Aldrich 29,424-1); dodecyl sulfate sodium salt $CH_3(CH_2)_{11}OSO_3Na$ (Aldrich 86,201-0); tetradecyl sulfate sodium salt $CH_3(CH_2)_{13}OSO_3Na$ (Aldrich 29,393-8); octadecyl sulfate sodium salt $CH_3(CH_2)_{17}OSO_3Na$ (Aldrich 29,394-6); 4-acetyl benzene sulfonic acid sodium salt $CH_3COC_6H_4SO_3Na$ (Aldrich 15,892-5); benzene sulfonic acid sodium salt $C_6H_5SO_3Na$ (Aldrich 14,728-1); 4-hydroxybenzene sulfonic acid sodium salt dihydrate $HOC_6H_4SO_3Na.2H_2O$ (Aldrich 28,298-7); sulfanilic acid sodium salt hydrate $4\text{-}H_2NC_6H_4SO_3Na.xH_2O$ (Aldrich 25,128-3); dodecyl benzene sulfonic acid sodium salt $C_{12}H_{25}C_6H_4SO_3Na$ (Aldrich 28,995-7); 2-formyl benzene sulfonic acid sodium salt dihydrate $HCOC_6H_4SO_3Na.2H_2O$ (Aldrich 23,938-0); 3-nitrobenzene sulfonic acid sodium salt $O_2NC_6H_4SO_3Na$ (Aldrich N2,200-2); 4-octylbenzene sulfonic acid sodium salt dihydrate $CH_3(CH_2)_7C_6H_4SO_3Na.2H_2O$ (Aldrich 28,748-2); cyclohexyl sulfamic acid sodium salt $C_6H_{11}NHSO_3Na$ (Aldrich 13,830-4); diphenyl amine-4-sulfonic acid sodium salt $C_6H_5NHC_6H_4SO_3Na$ (Aldrich 24,296-9); 2,4-dinitrobenzene sulfonic acid sodium salt $(O_2N)_2C_6H_3SO_3Na$ (Aldrich 25,993-4); sodium xylene sulfonate $(CH_3)_2C_6H_3SO_3Na$ (Aldrich 24,253-5); 3,5-dichloro-2-hydroxybenzene sulfonic acid sodium salt $Cl_2C_6H_2(OH)SO_3Na$ (Aldrich 23,882-1); 4-chloro-3-nitrobenzene sulfonic acid sodium salt $ClC_6H_3(NO_2)SO_3Na$ (Aldrich 22,725-0); 3,5-dibromo sulfanilic acid sodium salt $Br_2C_6H_2(NH_2)SO_3Na$ (Aldrich 26,814-3); 1,3-benzene disulfonic acid disodium salt $C_6H_4(SO_3Na)_2$ (Aldrich 25,980-2); 4-amino-1-naphthalene sulfonic acid, sodium salt hydrate $H_2NC_{10}H_6SO_3Na.xH_2O$; 6,7-dihydroxy-2-naphthalene sulfonic acid sodium salt $(HO)_2C_{10}H_5SO_3Na$ (Aldrich 21,896-0); 3,6-dihydroxy naphthalene-2,7-disulfonic acid disodium salt $(HO)_2C_{10}H_4(SO_3Na)_2$ (Aldrich 23,282-3); 4,5-dihydroxy naphthalene-2,7-disulfonic acid disodium salt dihydrate $(HO)_2C_{10}H_4(SO_3Na)_2.2H_2O$ (Aldrich 21,327-6 and 12,622-5); 8-hydroxy-7-(4-sulfo-1-naphthylazo)-5-quinoline sulfonic acid disodium salt (Aldrich 30,190-6); 2,6-naphthalene disulfonic acid disodium salt $C_{10}H_6(SO_3Na)_2$ (Aldrich N60-5); 1,3,6-naphthalene trisulfonic acid trisodium salt hydrate $C_{10}H_5(SO_3Na)_3.xH_2O$ (Aldrich 31,074-3); 3-amino-2,7-naphthalene disulfonic acid monosodium salt trihydrate $H_2NC_{10}H_5(SO_3H)SO_3Na.3H_2O$ (Aldrich 24,867-3); dioctyl sulfosuccinate sodium salt $CH_3(CH_2)_3CH(C_2H_5)CH_2O_2CCH_2CH(SO_3Na)COO—CH_2—CH(C_2H_5)(CH_2)_3CH_3$ (Aldrich D20,117-0); 2-chloroethane sulfonic acid sodium salt monohydrate $ClCH_2CH_2SO_3Na.H_2O$ (Aldrich 15,765-1); 3-chloro-2-hydroxy-1-propane sulfonic acid sodium salt hydrate $ClCH_2CH(OH)CH_2SO_3Na.xH_2O$ (Aldrich 32,533-3); 2-methyl-2-propene-1-sulfonic acid sodium salt $H_2C{=}C(CH_3)CH_2SO_3Na$ (Aldrich 18,608-2); vinyl sulfonic acid sodium salt $H_2C{=}CHSO_3Na$ (Aldrich 27,841-6); 3-amino-1-propane sulfonic acid sodium salt dihydrate $H_2N(CH_2)_3SO_3Na.2H_2O$ (Aldrich A7,612-5); benzene sulfinic acid sodium salt $C_6H_5SO_2Na$ (Aldrich 12,357-9); N-acetyl sulfanilamide sodium salt hydrate $H_2NC_6H_4SO_2N(COCH_3)Na.xH_2O$ (Aldrich 29,272-9); chloramine-B-hydrate $C_6H_5SO_2N(Cl)Na.xH_2O$ (Aldrich 28,304-5); chloramine-T-hydrate $CH_3C_6H_4SO_2N(Cl)Na.xH_2O$ (Aldrich 85,731-9); glycerol 2-phosphate disodium salt hydrate $(HOCH_2)_2CHOP(O)(ONa)_2.xH_2O$ (Aldrich 25,129-1); guanosine 2'(3')-monophosphate disodium salt monohydrate (Aldrich 85-202-3); 4-nitrophenyl phosphate disodium salt hexahydrate $O_2NC_6H_4OP(O)(ONa)_2.6H_2O$ (Aldrich N2,200-2); 2'-deoxy guanosine 5'-monophosphate sodium salt hydrate (Aldrich 85,222-8); α-D-glucose-1-phosphate disodium salt tetrahydrate (Aldrich 86,217-7); cytidine 5'-monophosphate disodium salt hydrate (Aldrich 85,795-5); pantothenic acid calcium salt monohydrate $[HOCH_2C(CH_3)_2CH(OH)CONHCH_2CH_2COO]_2Ca.H_2O$ (Aldrich 29,185-4 and 25,972-1); D-gluconic acid calcium salt $(HOH_2C[CH(OH)]_4COO)_2Ca$ (Aldrich 22,764-1); 2 keto-D-gluconic acid, hemicalcium salt dihydrate $[HOCH_2CH(OH)CH(OH)CH(OH)—CO—COO]_2Ca.2H_2O$ (Aldrich 28,638-9); 4-methyl-2-oxopentanoic acid calcium salt dihydrate $[(CH_3)_2CHCH_2COCOO]_2Ca.2H_2O$ (Aldrich 24,644-1); 3-methyl-2-oxobutanoic acid calcium salt dihydrate $[(CH_3)_2CHCOCOO]_2Ca.2H_2O$ (Aldrich 24,643-3); calcium propionate $(C_2H_5COO)_2Ca$ (Aldrich 34,445-1); D,L-glyceric acid calcium salt hydrate $[HOCH_2CH(OH)COO]_2Ca.xH_2O$ (Aldrich G,500-0); tricalcium dicitrate tetrahydrate $[OOCCH_2C(OH)(COO)CH_2COO]_2Ca_3.4H_2O$ (Aldrich 35,973-4); choline chloride phosphate calcium salt $ClN(CH_3)_3CH_2CH_2OPO_3Ca.4H_2O$ (Aldrich 25,045-7); 2-naphthyl phosphate calcium salt hydrate $[C_{10}H_7OP(O)(OH)O]_2Ca.xH_2O$ (Aldrich 26,162-9); D-gluconic acid magnesium salt $(HOCH_2[CH(OH)]_4COO)_2Mg$ (Aldrich 34,443-5); monoperoxyphthalic acid magnesium salt hexahydrate $(HO_3CC_6H_4COO)_2Mg.6H_2O$ (Aldrich 28,320-7); 2-naphthalene sulfonic acid, magnesium salt-bis(hexachloro cyclopentadiene) adduct (Aldrich 18,722-4); p-toluene sulfonic acid barium salt $(CH_3C_6H_4SO_3)_2Ba$ (Aldrich 25,042-2); diphenyl amine-4-sulfonic acid barium salt $(C_6H_5NHC_6H_4SO_3)_2Ba$ (Aldrich 26,178-5); pentafluorobenzene sulfonic acid barium salt $(C_6F_5SO_3)_2Ba$ (Aldrich 28,234-0); 2-cyanoethyl phosphate barium salt dihydrate $NC\text{-}CH_2CH_2OPO_3Ba.2H_2O$ (Aldrich 14,623-4); zinc stearate $[CH_3(CH_2)_{16}COO]_2Zn$ (Aldrich 30,756-4); zinc acetyl acetonate hydrate $[H_3C—C(O)—CH{=}C(CH_3)O_2]Zn.xH_2O$ (Aldrich 13,230-6); p-toluene sulfonic acid, zinc salt hydrate $(CH_3C_6H_4SO_3)_2Zn.xH_2O$ (Aldrich 34,549-0); 2-naphthyl sulfate, potassium salt (Aldrich 86,182-0); and the like, as well as mixtures thereof.

The salt compound is present in any effective amount relative to the substrate. Typically, the salt compound is present in an amount of from about 1 to about 50 percent by weight of the substrate, preferably from about 5 to about 30 percent by weight of the substrate, although the amount can be outside this range. The amount can also be expressed in terms of the weight of salt compound per unit area of substrate. Typically, the salt compound is present in an amount of from about 0.8 to about 40 grams per square meter of the substrate surface to which it is applied, and preferably from about 4 to about 24 grams per square meter of the substrate surface to which it is applied, although the amount can be outside these ranges.

The salt compound can be applied to the substrate as a coating which also includes a binder. Examples of suitable binder polymers include (a) hydrophilic polysaccharides and their modifications, such as (1) starch (such as starch SLS-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences Inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methocel AM 4, available from Dow Chemical Company)), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocoll, available from Berol Kem. A.B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd., also available as Tylose MH, MHK from Kalle A.G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company}, (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC7HOF, available from Hercules Chemical Company), (20) gum arabic (such as #G9752, available from Sigma Chemical Company), (21) carrageenan (such as #$C_{1013}$ available from Sigma Chemical Company), (22) Karaya gum (such as #G0503, available from Sigma Chemical Company), (23) xanthan (such as Keltrol-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agar-agar (such as that available from Pfaltz and Bauer Inc), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly (vinyl phosphate) (such as #4391 available from Poly Sciences Inc.), (3) poly (vinyl pyrrolidone) (such as that available from GAF Corporation), (4) vinyl pyrrolidone-vinyl acetate copolymers (such as #02587, available from Poly Sciences Inc.), (5) vinyl pyrrolidone-styrene copolymers (such as #371, available from Scientific Polymer Products), (6) poly (vinylamine) (such as #1562, available from Poly Sciences Inc.), (7) poly (vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl alcohol) ethoxylated #6573, available from Poly Sciences Inc.), and (8) poly (vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl pyrrolidone-diethylaminomethylmethacrylate) #16294 and #16295, available from Poly Sciences Inc.); (c) formaldehyde resins, such as (1) melamine-formaldehyde resin (such as BC 309, available from British Industrial Plastics Limited), (2) urea-formaldehyde resin (such as BC777, available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); (d) ionic polymers, such as (1) poly (2-acrylamide-2-methyl propane sulfonic acid) (such as #175 available from Scientific Polymer Products), (2) poly (N,N-dimethyl-3,5-dimethylene piperidinium chloride) (such as #401, available from Scientific Polymer Products), and (3) poly (methylene-guanidine) hydrochloride (such as #654, available from Scientific Polymer Products); (e) latex polymers, such as (1) cationic, anionic, and nonionic styrene-butadiene latexes (such as that available from Gen Corp Polymer Products, such as RES 4040 and RES 4100, available from Unocal Chemicals, and such as DL 6672A, DL6638A, and DL6663A, available from Dow Chemical Company), (2) ethylenevinylacetate latex (such as Airflex 400, available from Air Products and Chemicals Inc.), (3) vinyl acetate-acrylic copolymer latexes (such as synthemul 97-726, available from Reichhold Chemical Inc, Resyn 25-1110 and Resyn 25-1140, available from National Starch Company, and RES 3103 available from Unocal Chemicals, (4) quaternary acrylic copolymer latexes, particularly those of the formula

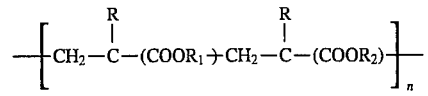

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like; (f) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company), (4) butadiene-maleic acid copolymers (such as #07787, available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporation as Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Polymer Products); (g) acrylamide containing polymers, such as (1) poly (acrylamide) (such as #02806, available from Poly Sciences Inc.), (2) acrylamide-acrylic acid copolymers (such as #04652, #02220, and #18545, available from Poly Sciences Inc.), and (3) poly (N,N-dimethyl acrylamide) (such as #004590, available from Poly Sciences Inc.); and (h) poly (alkylene imine) containing polymers, wherein alkylene has two (ethylene), three (propylene), or four (butylene) carbon atoms, such as (1) poly(ethylene imine) (such as #135, available from Scientific Polymer Products), (2) poly(ethylene imine) epichlorohydrin (such as #634, available from Scientific Polymer Products), and (3) alkoxylated poly (ethylene imine), wherein alkyl has one (methoxylated), two (ethoxylated), three (propoxylated), or four (butoxylated) carbon atoms (such as ethoxylated poly (ethylene imine #636, available from Scientific Polymer Products); and the like, as well as blends or mixtures of any of the above, with starches and latexes being particularly preferred because of their availability and applicability to paper. Any mixtures of the above ingredients in any relative amounts can be employed.

The binder, if present, can be present within the coating in any effective amount; typically the binder and the salt compound are present in relative amounts of from about 10 percent by weight binder and about 90 percent by weight salt compound to about 99 percent by weight binder and about 1 percent by weight salt compound, although the relative amounts can be outside of this range.

In addition, the coating of the recording sheets of the present invention can contain optional antistatic agents. Any suitable or desired antistatic agent or agents can be employed, such as quaternary salts and other materials as disclosed in, for example, copending applications Ser. Nos. 08/034,917, 08/034,943, 08/033,917, 08/034,445, and 08/033,918, the disclosures of each of which are totally incorporated herein by reference. The antistatic agent can be present in any effective amount; typically, the antistatic agent is present in an amount of from about 1 to about 5 percent by weight of the coating, and preferably in an amount of from about 1 to about 2 percent by weight of the coating, although the amount can be outside these ranges.

Further, the coating of the recording sheets of the present invention can contain one or more optional biocides. Examples of suitable biocides include (A) non-ionic biocides, such as (1) 2-hydroxypropylmethane thiosulfonate (Busan 1005, available from Buckman Laboratories Inc.); (2) 2-(thio cyanomethyl thio) benzothiazole (Busan 30WB, 72WB, available from Buckman Laboratories Inc.); (3) methylene bis (thiocyanate) (Metasol T-10, available from Calgon Corporation; AMA-110, available from Vinings Chemical Company; Vichem MBT, available from Vineland Chemical Company; Aldrich 10,509-0); (4)2-bromo-4'-hydroxyacetophenone (Busan 90, available from Buckman Laboratories); (5) 1,2-dibromo-2,4-dicyanobutane (Metasol CB-210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1,3,5-thiadiazine-2-thione (SLIME-TROL RX-28, available from Betz Paper Chem Inc.; Metasol D3T-A, available from Calgon Corporation; SLIME ARREST, available from Western Chemical Company); (10) a non-ionic blend of a sulfone, such as bis (trichloromethyl) sulfone and methylene bisthiocyanate (available as SLIME-TROL RX-38A from Betz Paper them Inc.); (11) a non-ionic blend of methylene bisthiocyanate and bromonitrostyrene (available as SLIME-TROL RX-41 from Betz Paper Chem Inc.); (12) a non-ionic blend of 2-(thiocyanomethylthio) benzothiazole (53.2% by weight) and 2-hydroxypropyl methanethiosulfonate (46.8% by weight) (available as BUSAN 25 from Buckman Laboratories Inc.); (13) a non-ionic blend of methylene bis(thiocyanate) 50 percent by weight and 2-(thiocyanomethylthio) benzothiazole 50 percent by weight (available as BUSAN 1009, 1009WB from Buckman Laboratories Inc.); (14) a non-ionic blend of 2-bromo-4'-hydroxyacetophenone (70 percent by weight) and 2-(thiocyanomethylthio) benzothiazole (30 percent by weight) (BUSAN 93, available from Buckman Laboratories Inc.); (15) a non-ionic blend of 5-chloro-2-methyl-4-isothiazoline-3-one (75 percent by weight) and 2-methyl-4-isothiazolin-3-one (25 percent by weight), (available as AMERSTAT 250 from Drew Industrial Division; NALCON 7647, from NALCO Chemical Company; Kathon LY, from Rohm and Haas Co.); and the like, as well as mixtures thereof; (B) anionic biocides, such as (1) anionic potassium N-hydroxymethyl-N-methyldithiocarbamate (available as BUSAN 40 from Buckman Larboratories Inc.); (2) an anionic blend of N-hydroxymethyl-N-methyl dithiocarbamate (80% by weight) and sodium 2-mercapto benzothiazole (20% by weight) (available as BUSAN 52 from Buckman Laboratories Inc.); (3) an anionic blend of sodium dimethyl dithiocarbamate 50 percent by weight and (disodium ethylenebis-dithiocarbamate) 50% by weight (available as METASOL 300 from Calgon Corporation; AMERSTAT 272 from Drew Industrial Division; SLIME CONTROL F from Western Chemical Company); (4) an anionic blend of N-methyldithiocarbamate 60 percent by weight and disodium cyanodithioimidocarbonate 40 percent by weight (available as BUSAN 881 from Buckman Laboratories Inc); (5) An anionic blend of methylene bis-thiocyanate (33% by weight), sodium dimethyldithiocarbamate (33% by weight), and sodium ethylene bisdithiocarbamate (33% by weight) (available as AMERSTAT 282 from Drew Industrial Division; AMA-131 from Vinings Chemical Company); (6) sodium dichlorophene (G-4-40, available from Givaudan Corp.); and the like, as well as mixtures thereof; (C) cationic biocides, such as (1) cationic poly (oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as SLIME TROL RX-31, RX-32, RX-32P, RX-33, from Betz Paper Chem Inc.); (3) a cationic blend of a sulfone, such as bis(trichloromethyl) sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem Inc.); and the like, as well as mixtures thereof. The biocide can be present in any effective amount; typically, the biocide is present in an amount of from about 10 parts per million to about 3 percent by weight of the coating, although the amount can be outside this range.

Additionally, the coating of the recording sheets of the present invention can contain optional filler components. Fillers can be present in any effective amount, and if present, typically are present in amounts of from about 1 to about 60 percent by weight of the coating composition. Examples of filler components include colloidal silicas, such as Syloid 74, available from Grace Company (preferably present, in one embodiment, in an amount of about 20 weight percent), titanium dioxide (available as Rutile or Anatase from NL Chem Canada, Inc.), hydrated alumina (Hydrad TMC-HBF, Hydrad TM-HBC, available from J. M. Huber Corporation), barium sulfate (K. C. Blanc Fix HD80, available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blend of calcium fluoride and silica, such as Opalex-C available from Kemira.O.Y, zinc oxide, such as Zoco Fax 183, available from Zo Chem, blends of zinc sulfide with barium sulfate, such as Lithopane, available from Schteben Company, and the like, as well as mixtures thereof. Brightener fillers can enhance color mixing and assist in improving print-through in recording sheets of the present invention.

Optionally, the coating of the recording sheet can also contain betaine. Betaine, of the formula

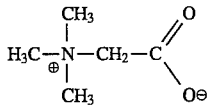

is available from Aldrich Chemical Co., Milwaukee, Wis. Betaine is present in the coating formulation in any effective or desired amount, typically from about 10 to about 50 percent by weight, although the amount can be outside this range.

The coating containing the salt compound is present on the substrate of the recording sheet of the present invention in any effective thickness. Typically, the total thickness of the coating layer (on each side of the substrate, if both surfaces are coated) is from about 1 to about 25 microns and preferably from about 5 to about 10 microns, although the thickness can be outside of these ranges.

The coating containing the salt compound (as well as the optional binder, antistatic agent, biocide, and/or filler, if present) can be applied to the substrate by any suitable technique, such as size press treatment, dip coating, reverse roll coating, extrusion coating, or the like. For example, the coating can be applied with a KRK size press (Kumagai Riki Kogyo Co., Ltd., Nerima, Tokyo, Japan) by dip coating and can be applied by solvent extrusion on a Faustel Coater. The KRK size press is a lab size press that simulates a commercial size press. This size press is normally sheet fed, whereas a commercial size press typically employs a continuous web. On the KRK size press, the substrate sheet is taped by one end to the carrier mechanism plate. The speed of the test and the roll pressures are set, and the coating solution is poured into the solution tank. A 4 liter stainless steel beaker is situated underneath for retaining the solution overflow. The coating solution is cycled once through the system (without moving the substrate sheet) to wet the surface of the rolls and then returned to the feed tank, where it is cycled a second time. While the rolls are being "wetted", the sheet is fed through the sizing rolls by pressing the carrier mechanism start button. The coated sheet is then removed from the carrier mechanism plate and is placed on a 12 inch by 40 inch sheet of 750 micron thick Teflon for support and is dried on the Dynamic Former drying drum and held under restraint to prevent shrinkage. The drying temperature is approximately 105° C. This method of coating treats both sides of the substrate simultaneously.

In dip coating, a web of the material to be coated is transported below the surface of the liquid coating composition by a single roll in such a manner that the exposed site is saturated, followed by removal of any excess coating by the squeeze rolls and drying at 100° C. in an air dryer. The liquid coating composition generally comprises the desired coating composition dissolved in a solvent such as water, methanol, or the like. The method of surface treating the substrate using a coater results in a continuous sheet of substrate with the coating material applied first to one side and then to the second side of this substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer at 100° C.

If desired, the salt material can be applied to the recording sheet in an imagewise fashion. For example, an aqueous solution of the salt can be incorporated into an ink jet printing apparatus and the solution can be jetted onto the substrate in imagewise fashion prior to application of the marking material to the substrate.

Recording sheets of the present invention can be employed in ink jet printing processes. One embodiment of the present invention is directed to a process which comprises applying an aqueous recording liquid to a recording sheet of the present invention in an imagewise pattern. Another embodiment of the present invention is directed to a printing process which comprises (1) incorporating into an ink jet printing apparatus containing an aqueous ink a recording sheet of the present invention, and (2) causing droplets of the ink to be ejected in an imagewise pattern onto the recording sheet, thereby generating images on the recording sheet. Ink jet printing processes are well known, and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference. In a particularly preferred embodiment, the printing apparatus employs a thermal ink jet process wherein the ink in the nozzles is selectively heated in an imagewise pattern, thereby causing droplets of the ink to be ejected in imagewise pattern. In another preferred embodiment, the substrate is printed with an aqueous ink and thereafter the printed substrate is exposed to microwave radiation, thereby drying the ink on the sheet. Printing processes of this nature are disclosed in, for example, U.S. Pat. No. 5,220,346, the disclosure of which is totally incorporated herein by reference.

The recording sheets of the present invention can also be used in any other printing or imaging process, such as printing with pen plotters, handwriting with ink pens, offset printing processes, or the like, provided that the ink employed to form the image is compatible with the ink receiving layer of the recording sheet.

Recording sheets of the present invention exhibit reduced curl upon being printed with aqueous inks, particularly in situations wherein the ink image is dried by exposure to microwave radiation. Generally, the term "curl" refers to the distance between the base line of the arc formed by recording sheet when viewed in cross-section across its width (or shorter dimension—for example, 8.5 inches in an 8.5×11 inch sheet, as opposed to length, or longer dimension—for example, 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet) and the arc formed by the sheet can be matched against a pre-draw n standard template curve.

Specific embodiments of the invention will now be described in detail. These examples are intended to be illustrative, and the invention is not limited to the materials, conditions, or process parameters set forth in these embodiments. All parts and percentages are by weight unless otherwise indicated.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

EXAMPLE I

Transparency sheets were prepared as follows. Blends of 70 percent by weight hydroxypropyl methyl cellulose (K35LV, obtained from Dow Chemical Co.) and 30 percent by weight of various salt compositions, each obtained from Aldrich Chemical Co., were prepared by mixing 56 grams of hydroxypropyl methyl cellulose and 24 grams of the salt composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 100 percent by weight hydroxypropyl methyl cellulose and contained no salt composition.

The transparency sheets thus prepared were incorporated into a Hewlett-Packard 500-C color ink jet printer containing inks of the following compositions:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICI, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 Watts output power at 2450 MHz frequency. The black images were "process black" (i.e., formed by superimposition of cyan, magenta, and yellow images). The drying times and optical densities for the resulting images were as follows:

| | Drying Time (seconds) | | | | Optical Density | | | |
|---|---|---|---|---|---|---|---|---|
| Salt | black | cyan | magenta | yellow | black | cyan | magenta | yellow |
| none | 30 | 20 | 30 | 20 | 2.50 | 2.07 | 1.45 | 0.99 |
| ammonium iron sulfate hexahydrate | 10 | 45 | 35 | 25 | 1.43 | 1.40 | 1.40 | 0.99 |
| ammonium iron sulfate dodecahydrate | 15 | 20 | 25 | 15 | 1.50 | 2.02 | 1.37 | 1.00 |
| potassium tetraborate tetrahydrate | 10 | 20 | 20 | 20 | 1.45 | 2.07 | 1.60 | 0.97 |
| sodium thiosulfate pentahydrate | 15 | 45 | 45 | 35 | 1.50 | 1.80 | 1.50 | 1.10 |
| sodium pyrophosphate decahydrate | 15 | 25 | 25 | 15 | 1.50 | 1.60 | 1.45 | 0.95 |
| magnesium nitrate hexahydrate | 25 | 20 | 10 | 10 | 2.30 | 2.10 | 1.40 | 0.88 |
| zinc sulfate heptahydrate | 10 | 20 | 30 | 10 | 1.68 | 1.60 | 1.50 | 0.95 |

As the results indicate, the process black images in all instances exhibited faster drying in the presence of the salts than in their absence. The magenta, cyan, and yellow images exhibited equivalent or faster drying times in the presence of the zinc sulfate heptahydrate, magnesium nitrate hexahydrate, potassium tetraborate tetrahydrate, and ammonium iron sulfate dodecahydrate salts compared to recording sheets in which they were absent, while still maintaining acceptable optical density values.

EXAMPLE II

Transparency sheets were prepared as follows. Blends of 70 percent by weight hydroxypropyl methyl cellulose (K35LV, obtained from Dow Chemical Co.) and 30 percent by weight of various salt compositions, each obtained from Aldrich Chemical Co., were prepared by mixing 56 grams of hydroxypropyl methyl cellulose and 24 grams of the salt composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 100 percent by weight hydroxypropyl methyl cellulose and contained no salt composition.

The transparency sheets thus prepared were incorporated into a Hewlett-Packard 500-C color ink jet printer containing inks of the following compositions:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICI, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

Images were generated by printing block patterns for magenta, cyan, yellow, and black. The images thus formed were allowed to dry at 25° C. The black images were "process black" (i.e., formed by superimposition of cyan, magenta, and yellow images). The drying times and optical densities for the resulting images were as follows:

| | Drying Time (minutes) | | | | Optical Density | | | |
|---|---|---|---|---|---|---|---|---|
| Salt | black | cyan | magenta | yellow | black | cyan | magenta | yellow |
| none | 10 | 5 | 5 | 2 | 2.95 | 2.10 | 1.37 | 0.99 |
| D-gluconic acid calcium salt | 7 | 3 | 3 | 1.5 | 1.50 | 2.15 | 1.80 | 1.02 |
| D-gluconic acid magnesium salt | 7 | 3 | 3 | 1.5 | 1.50 | 2.01 | 1.85 | 1.02 |
| (±)-pantothenic acid calcium salt | 7 | 2.5 | 2.5 | 1 | 2.20 | 2.50 | 1.80 | 0.97 |
| calcium propionate | 6 | 2.5 | 2.5 | 1 | 3.00 | 2.50 | 1.80 | 0.95 |
| ammonium citrate dibasic | 6 | 2.5 | 3 | 1 | 2.90 | 1.90 | 1.26 | 0.97 |
| calcium sulfate dihydrate | 6 | 2.5 | 3 | 1 | 2.90 | 1.85 | 1.30 | 0.98 |
| ammonium sulfate | 7 | 3 | 3 | 1 | 2.70 | 1.80 | 1.40 | 0.97 |

As the results indicate, the drying times of all transparencies containing salt compositions were faster than those not containing salt compositions. The images also exhibited either acceptable (although slightly lowered), equivalent, or improved optical densities.

EXAMPLE III

Transparency sheets were prepared as follows. Blends of 90 percent by weight hydroxypropyl methyl cellulose (K35LV, obtained from Dow Chemical Co.) and 10 percent by weight of various salt compositions, each obtained from Aldrich Chemical Co., were prepared by mixing 72 grams of hydroxypropyl methyl cellulose and 8 grams of the salt composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 100 percent by weight hydroxypropyl methyl cellulose and contained no salt composition.

The transparency sheets thus prepared were incorporated into a Hewlett-Packard 500-C color ink jet printer containing inks of the following compositions:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICI, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

Images were generated by printing block patterns for magenta, cyan, yellow, and black. The images thus formed were allowed to dry at 25° C. The black images were "process black" (i.e., formed by superimposition of cyan, magenta, and yellow images). The optical densities for the resulting images were as follows:

| | Optical Density | | | |
|---|---|---|---|---|
| Salt | black | cyan | magenta | yellow |
| none | 2.95 | 2.10 | 1.37 | 0.99 |
| calcium propionate | 2.92 | 2.68 | 1.45 | 0.67 |
| D-gluconic acid calcium salt | 2.56 | 2.45 | 1.37 | 0.70 |
| D-gluconic acid magnesium salt hydrate | 2.20 | 2.75 | 1.35 | 0.68 |
| D-gluconic acid potassium salt | 2.85 | 2.40 | 1.36 | 0.67 |
| D-gluconic acid sodium salt | 2.70 | 2.35 | 1.35 | 0.66 |
| (±)-pantothenic acid calcium salt hydrate | 2.58 | 2.53 | 1.38 | 0.70 |
| (±)-pantothenic acid calcium salt monohydrate | 2.90 | 2.72 | 1.38 | 0.70 |
| ammonium bromide | 2.90 | 2.00 | 1.26 | 0.97 |
| ammonium nitrate | 2.80 | 1.83 | 1.47 | 1.05 |
| sodium sulfate decahydrate | 2.80 | 2.00 | 1.50 | 1.01 |
| potassium chloride | 2.75 | 2.10 | 1.50 | 1.00 |

As the results indicate, in the presence of the salt composition, the optical density of the cyan images is enhanced, particularly in cases such as wherein the transparency contained calcium propionate, D-gluconic acid salts, and pantothenic acid salts.

EXAMPLE IV

Paper recording sheets were prepared as follows. Coating compositions containing various salt compositions, each obtained from Aldrich Chemical Co., were prepared by dissolving 50 grams of the salt in milliliters of water in a beaker and stirring for 1 hour at 25° C. The salt solutions thus prepared were then coated onto paper by a dip coating process (both sides coated in one operation) by providing paper base sheets in cut sheet form (8.5×11 inches) in a thickness of 100 microns. Subsequent to air drying at 100° C. (2 for 10 minutes and monitoring the difference in weight prior to and subsequent to coating, the sheets were each coated on each side with 500 milligrams, in a thickness of 5 microns (total coating weight 1 gram for two-sided sheets), of the salt composition For comparison purposes, an uncoated paper sheet treated with a composition containing only water by the same procedure was also imaged.

The paper sheets thus prepared were incorporated into a Hewlett-Packard 500-(2 color ink jet printer containing inks of the following composition:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical (20., Midland, Mich., 0.05 percent by weight polyethylene oxide (molecular weight 18,500), obtained from Union Carbide Co.), 30 percent by weight Projet Cyan 1 dye, obtained from ICI 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co., 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co., 3 percent by weight Hoechst Duasyn Brilliant Yellow SF-GL VP220, obtained from Hoechst, 72.45 percent by weight water. Images were generated with 100 percent ink coverage. After the image was printed, the paper sheets were each weighed precisely in a precision balance at time zero and periodically after that. The difference in weight was recorded as a function of time, 100 minutes being considered as the maximum time required for most of the volatile ink components to evaporate. (Volatiles were considered to be ink components such as water and glycols that can evaporate, as compared to components such as dyes, salts, and/or other non-volatile components. Knowing the weight of ink deposited at time zero, the amount of volatiles in the image can be calculated.) After 1000 minutes, the curl values of the paper were measured and are listed in the Table below. The black images were "process black" (i.e., formed by superimposition of cyan, magenta, and yellow images).

| Salt | Percent weight-loss of volatiles at various times (minutes) 5 | 10 | 15 | 30 | 60 | 120 | 1,000 minutes wt. loss % | curl in mm |
|---|---|---|---|---|---|---|---|---|
| none | 32 | 43 | 45 | 48 | 50 | 53 | 65 | 125 |
| ammonium bromide | 36 | 55 | 58 | 63 | 66 | 70 | 90 | 10 |
| ammonium sulfate | 34 | 50 | 57 | 60 | 69 | 72 | 87 | 10 |
| ammonium tetraborate tetrahydrate | 37 | 55 | 58 | 61 | 65 | 69 | 84 | 15 |
| potassium chloride | 34 | 50 | 56 | 58 | 64 | 68 | 85 | 15 |
| potassium sulfate | 42 | 60 | 67 | 75 | 77 | 80 | 87 | 15 |
| sodium tetraborate decahydrate | 38 | 52 | 60 | 65 | 71 | 73 | 99 | 0 |
| sodium thiosulfate pentahydrate | 37 | 55 | 61 | 65 | 68 | 72 | 96 | 5 |
| 1-hexane sulfonic acid sodium salt | 44 | 52 | 55 | 56 | 59 | 63 | 85 | 15 |
| D-gluconic acid potassium salt | 39 | 49 | 53 | 58 | 60 | 61 | 79 | 20 |
| D-gluconic acid sodium salt | 32 | 49 | 55 | 61 | 67 | 69 | 96 | 5 |
| D-gluconic acid calcium salt | 34 | 49 | 55 | 61 | 67 | 71 | 99 | 0 |
| D-gluconic acid magnesium salt hydrate | 40 | 61 | 70 | 78 | 84 | 89 | 100 | 0 |
| calcium propionate | 29 | 47 | 55 | 60 | 63 | 79 | 88 | 10 |
| (±)-pantothenic acid, calcium salt monohydrate | 34 | 45 | 49 | 53 | 66 | 68 | 76 | 25 |

As the results indicate, the papers coated with the salts exhibited higher weight loss of volatiles at time 1,000 minutes compared to the paper which had been treated with water alone. In addition, the papers coated with the salts exhibited lower curl values compared to the curl value for the paper treated with water alone.

EXAMPLE V

Paper recording sheets were prepared as follows. Coating compositions containing various salt compositions, each obtained from Aldrich Chemical Co., were prepared by dissolving 50 grams of the salt in milliliters of water in a beaker and stirring for 1 hour at 25° C. The salt solutions thus prepared were then coated onto paper by a dip coating process (both sides coated in one operation) by providing paper base sheets in cut sheet form (8.5×11 inches)in a thickness of 100 microns. Subsequent to air drying at 100° C. for 10 minutes and monitoring the difference in weight prior to and subsequent to coating, the sheets were each coated on each side with 500 milligrams, in a thickness of 5 microns (total coating weight 1 gram for two-sided sheets), of the salt composition For comparison purposes, an uncoated paper sheet treated with a composition containing only water by the same procedure was also imaged.

The paper sheets thus prepared were incorporated into a Hewlett-Packard 500-C color ink jet printer containing inks of the following composition:

Cyan: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 30 percent by weight Projet Cyan 1 dye, obtained from ICI, 45.45 percent by weight water.

Magenta: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 2.5 percent by weight Triton Direct Red 227, obtained from Tricon, 72.95 percent by weight water.

Yellow: 20 percent by weight ethylene glycol, 2.5 percent by weight benzyl alcohol, 1.9 percent by weight ammonium chloride, 0.1 percent by weight Dowicil 150 biocide, obtained from Dow Chemical Co., Midland, Mich., 0.05 percent by weight polyethylene oxide (molecular weight 18,500), obtained from Union Carbide Co.), 3 percent by weight Hoechst Duasyn Brilliant Yellow SF-GL VP220, obtained from Hoechst, 72.45 percent by weight water.

The black images were "process black" (i.e., formed by superimposition of cyan, magenta, and yellow images). The optical densities for the resulting images were as follows:

| Salt | Optical Density black | cyan | magenta | yellow |
|---|---|---|---|---|
| none | 1.08 | 1.18 | 1.03 | 0.80 |
| ammonium bromide | 1.20 | 1.20 | 1.09 | 0.81 |
| ammonium sulfate | 1.16 | 1.19 | 1.08 | 0.81 |
| ammonium tetraborate tetrahydrate | 1.01 | 1.07 | 0.89 | 0.67 |
| potassium chloride | 1.35 | 1.20 | 1.17 | 0.85 |
| potassium sulfate | 1.25 | 1.18 | 1.20 | 0.85 |
| sodium tetraborate decahydrate | 0.97 | 1.09 | 0.95 | 0.70 |
| sodium thiosulfate pentahydrate | 1.33 | 1.30 | 1.15 | 0.89 |
| 1-hexane sulfonic acid sodium salt | 1.03 | 1.12 | 1.01 | 0.75 |
| D-gluconic acid potassium salt | 1.06 | 1.13 | 0.97 | 0.73 |
| D-gluconic acid sodium salt | 1.03 | 1.13 | 0.98 | 0.73 |
| D-gluconic acid calcium salt | 1.04 | 1.03 | 0.95 | 0.72 |
| D-gluconic acid magnesium salt hydrate | 1.05 | 1.11 | 0.99 | 0.77 |
| calcium propionate | 1.42 | 1.28 | 1.21 | 0.91 |

-continued

| Salt | Optical Density | | | |
|---|---|---|---|---|
| | black | cyan | magenta | yellow |
| (±)-panthothenic acid, calcium salt monohydrate | 1.31 | 1.23 | 1.19 | 0.93 |

As the results indicate, the papers coated with the salt compositions exhibited acceptable optical densities for all colors.

EXAMPLE VI

Paper substrates (8.5×11 inches, Hammermill Alkaline, obtained from Hammermill Papers) were treated with the coating compositions indicated in the table below by placing the paper sheet on a hot metal platen, heating the paper surface with a heat gun, coating the complete felt surface of the paper with the indicated solution using a #8 wire wound bar, followed by rapid heat gun drying and placement in an oven at 60° C. The sheets thus formed were incorporated into a Hewlett-Packard Desk Jet 500 ink jet printer and imaged with an aqueous ink. Thereafter, the resulting imaged sheets were stored at 25% relative humidity for a period of 2 weeks. For comparison purposes, an untreated sheet of Hammermill Alkaline paper was also imaged under the same conditions. The results were as follows:

| coating | water (grams) | $CaCl_2$ (grams) | betaine (grams) | curl 10 minutes after printing | curl after 2 weeks at 25% RH |
|---|---|---|---|---|---|
| none | — | — | — | slight | 1-inch diameter scroll |
| 1 | 34.97 | 15.04 | — | none | none |
| 2 | 40.5 | 10 | — | none | 10-inch diameter scroll |
| 3 | 45.33 | 5 | — | none | 7-inch diameter scroll |
| 4 | 30.1 | 14.98 | 5 | none | 20-inch diameter scroll |
| 5 | 52.57 | 10.04 | 2.5 | none | 5-inch diameter scroll |

As the results indicate, the coated papers exhibited significantly reduced curling subsequent to imaging with the aqueous ink. It is believed that the presence of the betaine further reduced curling after storage at 25% RH for weeks.

Other embodiments and modifications of the present invention may occur to those skilled in the art subsequent to a review of the information presented herein; these embodiments and modifications, as well as equivalents thereof, are also included within the scope of this invention.

What is claimed is:

1. A printing process which comprises the steps of (a) providing a recording sheet which comprises a paper substrate and at least one monomeric salt; (b) applying an aqueous recording liquid to the recording sheet in an imagewise pattern; and (c) thereafter exposing the substrate to microwave radiation, thereby drying the recording liquid on the recording sheet.

2. A printing process according to claim 1 wherein the monomeric salt has a cation selected from the group consisting of ammonium, lithium, sodium, potassium, rubidium, cesium, beryllium, magnesium, calcium, barium, strontium, aluminum, scandium, titanium, vanadium, chromium, manganese, iron, cobalt, nickel, copper, zinc, gallium, germanium, yttrium, zirconium, niobium, molybdenum, rubidium, rhodium, palladium, silver, cadmium, indium, tin, antimony, lanthanum, halfnium, tantalum, tungsten, rhenium, osmium, iridium, platinum, gold, mercury, thallium, lead, bismuth, terbium, selenium, tellurium, ruthenium, neodymium, thulium, and mixtures thereof.

3. A printing process according to claim 1 wherein the monomeric salt has an anion selected from the group consisting of fluoride, chloride, bromide, iodide, astatide, oxide, sulfide, phosphate, hydrogen phosphate, dihydrogen phosphate, pyrophosphate, polyphosphate, sulfate, hydrogen sulfate, pyrosulfate, sulfite, hydrogen sulfite, pyrosulfite, thiosulfate, carbonate, hydrogen carbonate, tetraborate, metaborate, tetrafluoroborate, metasilicate, trisilicate, hexafluorosilicate, hexafluorophosphate, hexafluorotitanate, hexafluorozirconate, hexafluoroaluminate, nitrate, nitrite, hydroxide, and mixtures thereof.

4. A printing process according to claim 1 wherein the monomeric salt is selected from the group consisting of ammonium phosphate dibasic; ammonium sulfate; ammonium sulfite; ammonium thiosulfate; ammonium bromide; ammonium carbonate; ammonium hydrogen sulfate; ammonium bicarbonate; ammonium chloride; ammonium dihydrogen phosphate; ammonium tetraborate tetrahydrate; ammonium iron sulfate hexahydrate; ammonium iron sulfate dodecahydrate; potassium bromide; potassium carbonate; potassium carbonate sesquihydrate; potassium chloride; potassium hexafluorophosphate; potassium hexafluorosilicate; potassium hexafluorotitanate; potassium hexafluorozirconate; potassium hydrogen carbonate; potassium hydrogen sulfate; potassium iodide; potassium pyrophosphate; potassium pyrosulfate; potassium sulfate; potassium sulfite; potassium tetrafluoroborate; potassium phosphate monobasic; potassium phsophate tribasic; potassium tetraborate tetrahydrate; sodium bisulfate; sodium bisulfate monohydrate; sodium ammonium hydrogen phosphate tetrahydrate; sodium bisulfite; sodium bromide; sodium carbonate; sodium chloride; sodium hexafluoro aluminate; sodium hexafluoro silicate; sodium hydrogen carbonate; sodium iodide; sodium iodide dihydrate; sodium pyrosulfite; sodium metaborate hydrate; sodium metasilicate; sodium nitrite; sodium perborate tetrahydrate; sodium phosphate monobasic; sodium phosphate monobasic mono hydrate; sodium polyphosphate; sodium sulfate; sodium sulfite; sodium tripolyphosphate; sodium trisilicate; soda ash; sodium thiosulfate pentahydrate; sodium pyrophosphate decahydrate; magnesium bromide hexahydrate; magnesium chloride hexahydrate; magnesium nitrate hexahydrate; magnesium sulfate heptahydrate; magnesium hydrogen phosphate trihydrate; magnesium carbonate magnesium hydroxide pentahydrate; aluminum sulfate hexadecahydrate; aluminum potassium sulfate dodecahydrate; aluminum ammonium sulfate dodecahydrate; barium hydroxide octahydrate; calcium nitrate tetrahydrate; calcium sulfate dihydrate; strontium chloride hexahydrate; zinc nitrate hexahydrate; zinc sulfate heptahydrate; and mixtures thereof.

5. A printing process according to claim 1 wherein the monomeric salt has an anion selected from the group consisting of carboxylate anions, organic sulfate anions, organic sulfonate anions, organic molecules with $SO_2^-$ groups, organic phosphate anions, and mixtures thereof.

6. A printing process according to claim 1 wherein the monomeric salt has an anion selected from the group consisting of anions of aliphatic acids, anions of substituted aliphatic acids, anions of aromatic acids, anions of substituted aromatic acids, aliphatic sulfates, substituted aliphatic sulfates, aromatic sulfates, substituted aromatic sulfates, aliphatic sulfonates, substituted aliphatic sulfonates, aromatic sulfonates, substituted aromatic sulfonates, and mixtures thereof.

7. A printing process according to claim 1 wherein the monomeric salt has an anion selected from the group consisting of formate, acetate, propionate, butyrate, octanoate, oxalate, hydrogen oxalate, fumarate, oleate, 2,4-hexanedienate, palmitate, linoleate, succinate, malonate, maleate, isocitrate, stearate, 4-hydroxybutyrate, 4-hydroxybenzyl formate, 2-hydroxy valerate, 2,2-dichloropropionate, 3-methyl-2-oxobutanoate, 4-methyl-2-oxo-pentanoate, 2-ketobutyrate, 3-(trimethylsilyl) propionate, phenoxyacetate, iminodiacetate, nitrilo triacetate, acetoacetate, carbamate, tartarate, citrate, lactate, 2-ketoglutarate, gluconate, pyruvate, pantothenate, dihydroxytartarate, malate, epoxy succinate, 2-keto-gluconate, glycerate, ketomalonate, benzoate, phthalate, hydrogen phthalate, terephthalate, 4-aminobenzoate, 4,4'-dihydroxy azobenzene-3,3'-dicarboxylate, hippurate, 4-aminosalicylate, phenoxyacetate, peroxyphthalate, glycyrhizate, dodecyl sulfate, 3,5-dimethyl cyclohexyl sulfate, methyl sulfate, octyl sulfate, tetradecyl sulfate, octadecyl sulfate, 4-nitrophenyl sulfate, 1-butane sulfonate, 1-pentane sulfonate, 1-hexane sulfonate, 1-heptane sulfonate, 1 -octane sulfonate, 1-decane sulfonate, 1-dodecane sulfonate, 1-hexadecane sulfonate, vinyl sulfonate, 2-methyl-2-propene-1-sulfonate, 2-chloroethane sulfonate, 3-chloro-2-hydroxy-1-propane sulfonate, 3-amino-1-propane sulfonate, cyclohexyl sulfamic acid salts, dioctyl sulfosuccinate, benzene sulfonate, 1,3-benzene disulfonate, p-toluene sulfonate, dodecyl benzene sulfonate, 4-octylbenzene sulfonate, xylene sulfonate, 4-sulfobenzoate, 2,5-dihydroxy-1,4-benzene disulfonate, p-toluene thiosulfonate, 4-acetyl benzene sulfonate, 4-hydroxybenzene sulfonate, 3-nitrobenzene sulfonate, diphenylamine-4-sulfonate, 2,4-dinitrobenzene sulfonate, 2-formyl benzene sulfonate, 3,5-dichloro-2-hydroxybenzene sulfonate, 4-chloro-3-nitrobenzene sulfonate, pentafluorobenzene sulfonate, sulfanilic acid salts, 3,5-dibromo sulfanilic acid salts, 4-amino-1-naphthalene sulfonate, 6,7-dihydroxy-2-naphthalene sulfonate, 3,6-dihydroxy naphthalene-2,7-disulfonate, 4,5-dihydroxy naphthalene-2,7-disulfonate, 8-hydroxy-7-(4-sulfo-1-naphthylazo)-5-quinoline sulfonate, 2,6-naphthalene disulfonate, 1,3,6-naphthalene trisulfonate, 3-amino-2,7-naphthalene disulfonate, benzene sulfinic acid salts, N-acetyl sulfanilamide salts, chloramine-B-hydrate, chloramine-T hydrate, glycerol 2-phosphate, guanosine 2'(3')-monophosphate, 4-nitrophenyl phosphate, 2'-deoxy guanosine 5'monophosphate, a-glucose-1-phosphate, cytidine 5'-monophosphate, choline chloride phosphate, 2-naphthyl phosphate, 2-cyanoethyl phosphate, 2-naphthyl sulfate, and mixtures thereof.

8. A printing process according to claim 1 wherein the monomeric salt is selected from the group consisting of benzoic acid ammonium salt; tartaric acid diammonium salt; ammonium citrate; ammonium hydrogen oxalate hemihydrate; ammonium oxalate monohydrate; ammonium carbamate; glycyrhizicacid ammonium salt-trihydrate; acetic acid lithium salt dihydrate; lactic acid lithium salt; acetoacetic acid lithium salt; citric acid trilithium salt hydrate; dodecyl sulfate lithium salt; formic acid potassium salt; acetic acid potassium salt; benzoic acid potassium salt; oleic acid potassium salt; 2,4-hexadienoic acid potassium salt; 2-ketoglutaric acid mono potassium salt; potassium oxalate monohydrate; tartaric acid dipotassium salt hydrate; gluconic acid potassium salt; potassium hydrogen phthalate; citric acid tripotassium salt monohydrate; 4-sulfo benzoic acid potassium salt; 4-nitrophenyl sulfate potassium salt; 3,5-dimethyl cyclohexyl sulfate potassium salt; 1,3-benzene disulfonic acid dipotassium salt; 2,5-dihydroxy-1,4-benzene disulfonic acid dipotassium salt; p-toluene thio sulfonic acid potassium salt; acetic acid sodium salt; propionic acid sodium salt; butyric acid sodium salt; octanoic acid sodium salt; palmitic acid sodium salt; formic acid sodium salt; benzoic acid sodium salt; 4-hydroxybutyric acid sodium salt; 4-hydroxybenzyl formic acid sodium salt; 2-hydroxy valeric acid sodium salt hydrate; gluconic acid sodium salt; 2,2-dichloropropionic acid sodium salt; 3-methyl-2-oxobutanoic acid sodium salt; 4-methyl-2-oxopentanoic acid sodium salt; 2-keto butyric acid sodium salt monohydrate; 2-keto glutaric acid monosodium salt; pyruvic acid sodium salt; 3-(trimethylsilyl) propionic acid sodium salt; linoleic acid sodium salt; pantothenic acid sodium salt; hippuric acid sodium salt hydrate; 4-amino benzoic acid sodium salt; 4-amino salicyclic acid sodium salt dihydrate; phenoxy acetic acid sodium salt hemihydrate; oleic acid sodium salt; succinic acid disodium salt; dihydroxy tartaric acid disodium salt hydrate; terephthalic acid disodium salt hydrate; malonic acid disodium salt monohydrate; malic acid disodium salt hydrate; tartaric acid disodium salt dihydrate; 4,4'-dihydroxy azobenzene-3,3'-dicarboxylic acid disodium salt; iminodiacetic acid disodium salt monohydrate; ketomalonic acid monohydrate disodium salt; fumaric acid disodium salt; maleic acid disodium salt monohydrate; citric acid disodium salt; epoxy succinic acid disodium salt; citric acid trisodium salt dihydrate; isocitric acid trisodium salt hdyrate; nitrilo triacetic acid trisodium salt monohydrate; 1-butane sulfonic acid sodium salt; 1-pentane sulfonic acid sodium salt; 1-hexane sulfonic acid sodium salt; 1-heptane sulfonic acid sodium salt; 1-octane sulfonic acid sodium salt; 1-decane sulfonic acid sodium salt; 1-dodecane sulfonic acid sodium salt; 1-hexadecane sulfonic acid sodium salt; methyl sulfate sodium salt hydrate; octyl sulfate sodium salt; dodecyl sulfate sodium salt; tetradecyl sulfate sodium salt; octadecyl sulfate sodium salt; 4-acetyl benzene sulfonic acid sodium salt; benzene sulfonic acid sodium salt; 4-hydroxybenzene sulfonic acid sodium salt dihydrate; sulfanilic acid sodium salt hydrate; dodecyl benzene sulfonic acid sodium salt; 2-formyl benzene sulfonic acid sodium salt dihydrate; 3-nitrobenzene sulfonic acid sodium salt; 4-octylbenzene sulfonic acid sodium salt dihydrate; cyclohexyl sulfamic acid sodium salt; diphenyl amine-4-sulfonic acid sodium salt; 2,4-dinitrobenzene sulfonic acid sodium salt; sodium xylene sulfonate; 3,5-dichloro-2-hydroxybenzene sulfonic acid sodium salt; 4-chloro-3-nitrobenzene sulfonic acid sodium salt; 3,5-dibromo sulfanilic acid sodium salt; 1,3-benzene disulfonic acid disodium salt; 4-amino-1-naphthalene sulfonic acid sodium salt hydrate; 6,7-dihydroxy-2-naphthalene sulfonic acid sodium salt; 3,6-dihydroxy naphthalene-2,7-disulfonic acid disodium salt; 4,5-dihydroxy naphthalene-2,7-disulfonic acid disodium salt dihydrate; 8-hydroxy-7-(4-sulfo-1-naphthylazo)-5-quinoline sulfonic acid disodium salt; 2,6-naphthalene disulfonic acid disodium salt; 1,3,6-naphthalene trisulfonic acid trisodium salt hydrate; 3-amino-2,7-naphthalene disulfonic acid monosodium salt trihydrate; dioctyl sulfosuccinate sodium salt; 2-chloroethane sulfonic acid sodium salt monohydrate; 3-chloro-2-hydroxy-1-propane sulfonic acid sodium salt hydrate; 2-methyl-2-propene-1-sulfonic acid sodium salt; vinyl sulfonic acid sodium salt; 3-amino-1-propane sulfonic acid sodium salt dihydrate; benzene sulfinic acid sodium salt; N-acetyl sulfanilamide sodium salt hydrate; chloramine-B-hydrate; chloramine-T-hydrate; glycerol 2-phosphate disodium salt hydrate; guanosine 2'(3')-monophosphate disodium salt monohydrate; 4-nitrophenyl phosphate disodium salt hexahydrate; 2'-deoxy guanosine 5'-monophosphate sodium salt hydrate; α-glucose-1-phosphate disodium salt tetrahydrate; cytidine 5'-monophosphate disodium salt hydrate; pantothenic acid calcium salt monohydrate; gluconic acid calcium salt; 2 keto-gluconic acid hemicalcium salt dihydrate; 4-methyl-2-oxopentanoic acid calcium salt dihydrate; 3-methyl-2-oxobutanoic acid calcium salt dihydrate; calcium propionate; glyceric acid calcium salt hydrate; tricalcium dicitrate tetrahydrate; choline chloride phosphate calcium salt; 2-naphthyl phosphate calcium salt hydrate; gluconic acid magnesium salt; monoperoxyphthalic acid magnesium salt hexahydrate; 2-naphthalene sulfonic acid magnesium salt-bis(hexachloro cyclopentadiene) adduct; p-toluene sulfonic acid barium salt; diphenyl amine-4-sulfonic acid barium salt; pentafluorobenzene sulfonic acid barium salt; 2-cyanoethyl phosphate barium salt dihydrate; zinc stearate; zinc acetyl acetonate hydrate; p-toluene sulfonic acid zinc salt hydrate; magnesium acetate tetrahydrate; calcium oxalate hydrate; zinc acetate dihydrate; 2-naphthyl sulfate potassium salt; and mixtures thereof.

9. A printing process according to claim 1 wherein the monomeric salt is present on the substrate in an amount of from about 1 to about 50 percent by weight of the substrate.

10. A printing process according to claim 1 wherein the monomeric salt is present on the substrate in an amount of from about 0.8 to about 40 grams per square meter of the substrate.

11. A printing process according to claim 1 wherein the recording sheet further comprises a polysaccharide binder.

12. A printing process according to claim 1 wherein the recording sheet further comprises a quaternary acrylic copolymer latex binder.

13. A printing process according to claim 1 wherein the recording sheet further comprises a binder and wherein the binder and the monomeric salt are present in relative amounts of from about 10 percent by weight binder and about 90 percent by weight salt to about 99 percent by weight binder and about 1 percent by weight salt.

14. A printing process according to claim 1 wherein the recording sheet further comprises a binder and wherein the binder and the monomeric salt are coated onto the substrate in a thickness of from about 1 to about 25 microns.

15. A printing process according to claim 1 wherein the monomeric salt is a salt of a divalent metal.

16. A printing process according to claim 1 wherein the monomeric salt is selected from the group consisting of calcium salts, magnesium salts, strontium salts, barium salts, zinc salts, copper (II) salts, cobalt (II) salts, mercury (II) salts, cadmium (II) salts, tin (II) salts, manganese (II) salts, and mixtures thereof.

17. A printing process which comprises the steps of (a) incorporating into an ink jet printing apparatus a recording sheet which comprises a substrate and at least one monomeric salt, wherein the ink jet printing apparatus also contains an aqueous ink; (b) causing droplets of the ink to be ejected in an imagewise pattern onto the recording sheet, thereby generating images on the recording sheet; and (c) thereafter exposing the substrate to microwave radiation, thereby drying the recording liquid on the recording sheet, wherein the printing apparatus employs a thermal ink jet process wherein the ink in the nozzles is selectively heated in an imagewise pattern, thereby causing droplets of the ink to be ejected in imagewise pattern.

18. A printing process according to claim 17 wherein the substrate is a transparent polymeric material.

19. A printing process which comprises the steps of (a) providing a recording sheet which comprises a substrate and at least one monomeric salt; (b) applying an aqueous recording liquid to the recording sheet in an imagewise pattern; and (c) thereafter exposing the substrate to microwave radiation, thereby drying the recording liquid on the recording sheet, wherein the recording sheet also contains betaine.

20. A printing process according to claim 19 wherein the substrate is paper.

* * * * *